US011203827B2

(12) United States Patent
Luedecke et al.

(10) Patent No.: US 11,203,827 B2
(45) Date of Patent: Dec. 21, 2021

(54) METHOD OF MAKING ARTICLE WITH RIBBON STRUCTURE AND EMBROIDERED EDGES

(71) Applicant: Under Armour, Inc., Baltimore, MD (US)

(72) Inventors: Tom Luedecke, Portland, OR (US); Carmen Zhu, Dong Won (CN)

(73) Assignee: Under Armour, Inc., Baltimore, MD (US)

( * ) Notice: Subject to any disclaimer, the term of this patent is extended or adjusted under 35 U.S.C. 154(b) by 18 days.

(21) Appl. No.: 16/787,842

(22) Filed: Feb. 11, 2020

(65) Prior Publication Data

US 2020/0173083 A1 Jun. 4, 2020

Related U.S. Application Data

(63) Continuation of application No. 16/026,713, filed on Jul. 3, 2018, now Pat. No. 10,619,280.

(51) Int. Cl.

| | |
|---|---|
| ***D05C 7/08*** | (2006.01) |
| ***A43B 23/02*** | (2006.01) |
| ***D05C 17/00*** | (2006.01) |

(52) U.S. Cl.

CPC ..... *D05C 7/08* (2013.01); *A43B 23/025* (2013.01); *A43B 23/0215* (2013.01); *A43B 23/0275* (2013.01); *D05C 17/00* (2013.01)

(58) Field of Classification Search

CPC ..... D05B 35/08; D05B 7/08; D05B 17/00; D05C 17/00; D05C 9/02; D05C 7/08; A43B 1/04; A43B 23/025; A43B 7/08; A43B 23/0215; A43B 23/0275

See application file for complete search history.

(56) References Cited

U.S. PATENT DOCUMENTS

| | | | |
|---|---|---|---|
| 313,301 | A | 3/1885 | Cross |
| 888,476 | A | 5/1908 | Davis |
| 1,124,184 | A | 1/1915 | Straub |
| 1,217,463 | A | 2/1917 | Krieger |
| 1,314,239 | A | 8/1919 | Bancroft |

(Continued)

FOREIGN PATENT DOCUMENTS

| | | |
|---|---|---|
| CN | 2712122 | 7/2005 |
| CN | 201431021 | 3/2010 |

(Continued)

OTHER PUBLICATIONS

Paiho Sparta III Website, available at: http://www.paiho.com/index.php/en/menu-en-left-np-sparta (Nov. 3, 2015).

(Continued)

*Primary Examiner* — Danny Worrell

(74) *Attorney, Agent, or Firm* — Plumsea Law Group, LLC

(57) ABSTRACT

A method of making an article of footwear with an upper including a ribbon structure is disclosed. The method includes laying down ribbon elements in straight and winding sections. The method includes stitching or otherwise attaching the ribbon elements to a backing layer. The method also includes embroidering a periphery of the ribbon structure to tack down any raised portions of the ribbon at the periphery. The method also includes inserting a lace through loops in the ribbon structure.

20 Claims, 19 Drawing Sheets

(56) References Cited

U.S. PATENT DOCUMENTS

| | | | | |
|---|---|---|---|---|
| 1,469,222 | A | 10/1923 | La Chapelle | |
| 2,413,824 | A | 1/1947 | Glassman | |
| 3,570,151 | A | 3/1971 | Eaton | |
| 3,704,474 | A | 12/1972 | Winkler | |
| 4,027,406 | A | 6/1977 | Salvatore | |
| 4,254,563 | A | 3/1981 | Bruno | |
| 4,393,605 | A | 7/1983 | Spreng | |
| 5,673,639 | A | 10/1997 | Miyachi et al. | |
| 6,060,145 | A | 5/2000 | Smith et al. | |
| 6,128,835 | A | 10/2000 | Ritter et al. | |
| 6,267,068 | B1 | 7/2001 | Fickers et al. | |
| 7,032,328 | B2 | 4/2006 | Wilson et al. | |
| 7,089,691 | B1 | 8/2006 | Silvera | |
| 7,115,315 | B2 | 10/2006 | Fowler | |
| 7,293,371 | B2 | 11/2007 | Aveni | |
| 8,122,616 | B2 | 2/2012 | Meschter et al. | |
| 8,266,827 | B2 * | 9/2012 | Dojan | A43B 23/025 36/45 |
| 8,595,878 | B2 | 12/2013 | Huffa et al. | |
| 8,631,589 | B2 | 1/2014 | Dojan et al. | |
| 8,656,606 | B2 | 2/2014 | Hooper | |
| 8,819,963 | B2 | 9/2014 | Dojan et al. | |
| 8,904,671 | B2 | 12/2014 | Dojan et al. | |
| 8,925,129 | B2 | 1/2015 | Dojan et al. | |
| 8,973,288 | B2 | 3/2015 | Dojan et al. | |
| 9,179,739 | B2 | 11/2015 | Bell et al. | |
| 9,420,844 | B2 | 8/2016 | Meir et al. | |
| 9,622,542 | B2 | 4/2017 | Greene | |
| 9,655,407 | B2 | 5/2017 | Reinhardt et al. | |
| 2002/0148142 | A1 | 10/2002 | Oorei et al. | |
| 2002/0178610 | A1 | 12/2002 | Cheng | |
| 2003/0148076 | A1 | 8/2003 | Huang | |
| 2004/0118018 | A1 | 6/2004 | Dua | |
| 2005/0153614 | A1 | 7/2005 | Dohler | |
| 2005/0241181 | A1 | 11/2005 | Cheng | |
| 2005/0262734 | A1 | 12/2005 | Cheng | |
| 2005/0262735 | A1 | 12/2005 | Cheng | |
| 2006/0048413 | A1 | 3/2006 | Sokolowski et al. | |
| 2006/0059715 | A1 | 3/2006 | Aveni | |
| 2007/0271822 | A1 | 11/2007 | Meschter | |
| 2009/0071041 | A1 | 3/2009 | Hooper | |
| 2009/0133287 | A1 | 5/2009 | Meschter | |
| 2009/0199435 | A1 * | 8/2009 | Robinson, Jr. | A43C 11/16 36/108 |
| 2010/0107442 | A1 | 5/2010 | Hope et al. | |
| 2011/0041359 | A1 | 2/2011 | Dojan et al. | |
| 2011/0237995 | A1 | 9/2011 | Ota et al. | |
| 2011/0287212 | A1 | 11/2011 | Miloslavsky | |
| 2012/0023778 | A1 * | 2/2012 | Dojan | A43C 11/002 36/58.5 |
| 2012/0023786 | A1 | 2/2012 | Dojan | |
| 2012/0055044 | A1 | 3/2012 | Dojan et al. | |
| 2012/0198727 | A1 * | 8/2012 | Long | A43C 1/00 36/25 R |
| 2012/0297642 | A1 | 11/2012 | Schaefer et al. | |
| 2012/0324658 | A1 | 12/2012 | Dojan et al. | |
| 2013/0019500 | A1 * | 1/2013 | Greene | A43B 13/223 36/50.1 |
| 2013/0019501 | A1 | 1/2013 | Gerber | |
| 2013/0081307 | A1 | 4/2013 | del Biondi et al. | |
| 2013/0139329 | A1 | 6/2013 | Ferniani et al. | |
| 2013/0247417 | A1 | 9/2013 | Nurse et al. | |
| 2013/0255103 | A1 | 10/2013 | Dua et al. | |
| 2013/0312284 | A1 | 11/2013 | Berend et al. | |
| 2014/0020193 | A1 | 1/2014 | Dojan et al. | |
| 2014/0059883 | A1 * | 3/2014 | Adeagbo | A43B 13/04 36/28 |
| 2014/0130270 | A1 | 5/2014 | Baudouin et al. | |
| 2014/0157623 | A1 | 6/2014 | Dekovic | |
| 2014/0173934 | A1 | 6/2014 | Bell | |
| 2014/0237858 | A1 | 8/2014 | Adami et al. | |
| 2014/0238082 | A1 | 8/2014 | Meir | |
| 2014/0283411 | A1 | 9/2014 | Nabernik et al. | |
| 2014/0310986 | A1 | 10/2014 | Tamm et al. | |
| 2014/0338222 | A1 | 11/2014 | Song | |
| 2014/0373389 | A1 | 12/2014 | Bruce | |
| 2015/0210034 | A1 | 7/2015 | Tarrier et al. | |
| 2015/0272272 | A1 | 10/2015 | Berns et al. | |
| 2015/0272274 | A1 | 10/2015 | Berns et al. | |
| 2016/0213095 | A1 | 7/2016 | Kohatsu et al. | |
| 2016/0286898 | A1 | 10/2016 | Manz et al. | |
| 2016/0316855 | A1 | 11/2016 | Berns et al. | |
| 2016/0316856 | A1 | 11/2016 | Berns et al. | |
| 2016/0345675 | A1 | 12/2016 | Bruce et al. | |
| 2016/0345677 | A1 | 12/2016 | Bruce et al. | |
| 2016/0345678 | A1 | 12/2016 | Mokos | |
| 2016/0353828 | A1 | 12/2016 | Chen | |
| 2016/0366980 | A1 | 12/2016 | Bell et al. | |
| 2017/0143076 | A1 | 5/2017 | Farris | |
| 2017/0156434 | A1 | 6/2017 | Tamm et al. | |
| 2017/0156439 | A1 | 6/2017 | Yoshida et al. | |
| 2017/0156445 | A1 | 6/2017 | Guest et al. | |
| 2017/0157846 | A1 | 6/2017 | Miller et al. | |
| 2017/0202309 | A1 | 7/2017 | Steman et al. | |
| 2017/0332722 | A1 | 11/2017 | Dealey et al. | |
| 2017/0340064 | A1 | 11/2017 | Salomon | |
| 2017/0354202 | A1 | 12/2017 | Cai et al. | |
| 2018/0116317 | A1 | 5/2018 | Inoue et al. | |
| 2019/0008235 | A1 | 1/2019 | Wu | |
| 2019/0017205 | A1 | 1/2019 | Luedecke | |

FOREIGN PATENT DOCUMENTS

| | | | |
|---|---|---|---|
| CN | 103989290 | | 8/2014 |
| FR | 2626201 | A1 | 7/1989 |
| GB | 1079731 | A | 8/1967 |
| JP | 06057613 | A | 3/1994 |
| JP | 08246323 | A | 9/1996 |
| JP | 2016195676 | A | 11/2016 |
| TW | 340310 | | 9/1998 |
| TW | 351073 | | 1/1999 |
| TW | 351670 | | 2/1999 |
| TW | 353601 | | 3/1999 |
| TW | 412939 | | 11/2000 |
| TW | 503275 | | 9/2002 |
| TW | 521584 | | 2/2003 |
| TW | M257116 | | 2/2005 |
| TW | M357218 | | 5/2009 |
| TW | M378896 | | 4/2010 |
| TW | M420202 | | 1/2012 |
| TW | M433118 | | 7/2012 |
| TW | M433121 | | 7/2012 |
| TW | M437635 | | 9/2012 |
| TW | M451012 | | 4/2013 |
| TW | M456105 | | 7/2013 |
| TW | M476494 | | 4/2014 |
| TW | M476496 | | 4/2014 |
| TW | M527445 | | 8/2016 |
| WO | 90/03744 | | 4/1990 |
| WO | 2015038243 | | 3/2015 |
| WO | 2019013983 | | 1/2019 |

OTHER PUBLICATIONS

International Search Report and Written Opinion dated Sep. 20, 2018 in PCT/US2018/039904.

International Preliminary Report on Patentability dated Jan. 14. 2021 for PCT Application No. PCT/US2019/019492.

International Search Report and Written Opinion dated May 1, 2019 for Application No. PCT/US2019019481.

International Search Report and Written Opinion dated May 13, 2019 for Application No. PCT/US2019/019486.

International Search Report and Written Opinion dated May 1, 2019 for Application No. PCT/US2019/019490.

International Search Report and Written Opinion dated May 7, 2019 for Application No. PCT/US2019/019492.

Wikipedia, "Stich (textile arts)" May 6, 2016 (May 6, 2016), retrieved on Apr. 24, 2019 from https://en.wikipedia.org/w/index.php?title=Stitch_(textile_arts)&oldid=718918887.

International Search Report and Written Opinion dated Sep. 11, 2019 for Application No. PCT/US2019/038388.

(56) References Cited

OTHER PUBLICATIONS

International Search Report and Written Opinion dated Sep. 17, 2019 for Application No. PCT/US2019/038392.

* cited by examiner

METHOD OF MAKING ARTICLE WITH RIBBON STRUCTURE AND EMBROIDERED EDGES

CROSS-REFERENCE TO RELATED APPLICATION

This application claims priority to and is a continuation of U.S. application Ser. No. 16/026,713, filed Jul. 3, 2018, and titled "Method of Making Article with Ribbon Structure and Embroidered Edges," the entirety of which application is herein incorporated by reference.

BACKGROUND

Embroidery is a traditional method of decorating, tailoring, mending, patching, or reinforcing textile materials by sewing with a needle and stitching material. Hand-embroidered goods date back as late as the Warring States period in China. During the industrial revolution, the invention of the sewing machine and dedicated embroidery machines expanded the use of the technique. Modern embroidery techniques may utilize machine-readable code to autonomously create an embroidery pattern on a sheet of textile materials. Textile materials include fabrics such as cotton, wool, or silk, as well as leather, foam, polymer sheets, and synthetic equivalents. On the textile materials, a number of stitch techniques (such as the chain stitch, the buttonhole or blanket stitch, the running stitch, the satin stitch, or the cross stitch) may be used depending on the purpose of the embroidery. The stitching techniques may be used in combination to form a variety of set patterns. The stitching patterns may be decorative; for example, the pattern may form a flower or series of flowers. Alternatively, the stitching may be structural, such as stitching along the edges of a garment to reinforce the seams. In further cases, the stitching may be both decorative and functional, such as the use of a floral pattern used to reinforce a patch.

Typically, a thread or yarn is used as the stitching material and stitched into the textile. Commonly, the thread or yarn may be made of cotton or rayon, as well as traditional materials like wool, linen, or silk. However, embroidery may also sew in dissimilar materials to the textile, usually for decorative purposes. For example, thread created out of precious metals such as gold or silver may be embroidered within more traditional fabrics such as silk. Additional elements (such as beads, quills, sequins, pearls, or entire strips of metal) may be sewn in during embroidery. These elements may be sewn in along with yarn or thread using a variety of stitching techniques, depending on the desired placements of the elements.

SUMMARY

In one aspect, an article of footwear includes an upper with a ribbon structure. The ribbon structure includes an inner side, an outer side and a peripheral portion. The ribbon structure further includes a curved ribbon section disposed adjacent to the peripheral portion. The upper also includes an embroidered border element that is embroidered along the peripheral portion and covers the curved ribbon section on the outer side.

In another aspect, an article of footwear includes an upper with a ribbon structure. The ribbon structure includes an inner side, an outer side and a peripheral portion. The ribbon structure further includes a first open loop portion disposed at the peripheral portion and the ribbon structure includes a second open loop portion disposed at the peripheral portion. The first open loop portion overlaps with the second open loop portion.

In another aspect, an article of footwear includes an upper with a ribbon structure. The ribbon structure includes an inner side, an outer side and a peripheral portion. The ribbon structure also includes an open loop portion disposed at the peripheral portion and the article includes a lace extending through the open loop portion.

In another aspect, a method of making an upper for an article of footwear includes laying down a continuous ribbon element on a backing layer, where laying down the continuous ribbon element includes laying down a straight ribbon section and a curved ribbon section. The method also includes stitching the continuous ribbon element in place and embroidering a border element over the curved ribbon section.

In another aspect, a method of making an upper for an article of footwear includes laying down a continuous ribbon element on a backing layer, where laying down the continuous ribbon element includes laying down an open loop portion of the continuous ribbon element. The open loop portion includes a first straight ribbon section, a second straight ribbon section and a curved ribbon section. The method also includes stitching the continuous ribbon element in place by embroidering an embroidered portion across the first straight ribbon section and the second straight ribbon section.

In another aspect, a method of making an upper for an article of footwear includes laying down a continuous ribbon element on a backing layer to form a first open loop portion, stitching the first open loop portion to the backing layer, laying down the continuous ribbon element on the first open loop portion to form a second open loop portion and stitching the second open loop portion to the first open loop portion.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, with emphasis instead being placed upon illustrating the principles of the embodiments. Moreover, in the figures, like reference numerals designate corresponding parts throughout the different views.

DETAILED DESCRIPTION

The embodiments are related to an article including one or more ribbons, or portions of ribbon (e.g., a ribbon section). As used herein, the term "article" refers broadly to articles of footwear, articles of apparel (e.g., clothing), as well as accessories and/or equipment. For the purposes of general reference, an article is any item designed to be worn by or on a user, or act as an accessory. In some embodiments, an article may be an article of footwear, such as a shoe, sandal, boot, etc. In other embodiments, an article may be an article of apparel, such as a garment, including shirts, pants, jackets, socks, undergarments, or any other conventional item. In still other embodiments, an article may be an accessory such as a hat, glove, or bag worn by the wearer.

Articles of footwear include, but are not limited to, hiking boots, soccer shoes, football shoes, sneakers, running shoes, cross-training shoes, rugby shoes, basketball shoes, baseball shoes as well as other kinds of shoes. Moreover, in some embodiments, components may be configured for various kinds of non-sports-related footwear, including, but not limited to, slippers, sandals, high-heeled footwear, loafers as well as any other kinds of footwear. Articles of apparel include, but are not limited to, socks, pants, shorts, shirts, sweaters, undergarments, hats, gloves, as well as other kinds of garments. Accessories include scarves, bags, purses, backpacks, as well as other accessories. Equipment may include various kinds of sporting equipment including, but not limited to, bats, balls, various sporting gloves (e.g., baseball mitts, football gloves, ski gloves, etc.), golf clubs, as well as other kinds of sporting equipment.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

Figure 1:
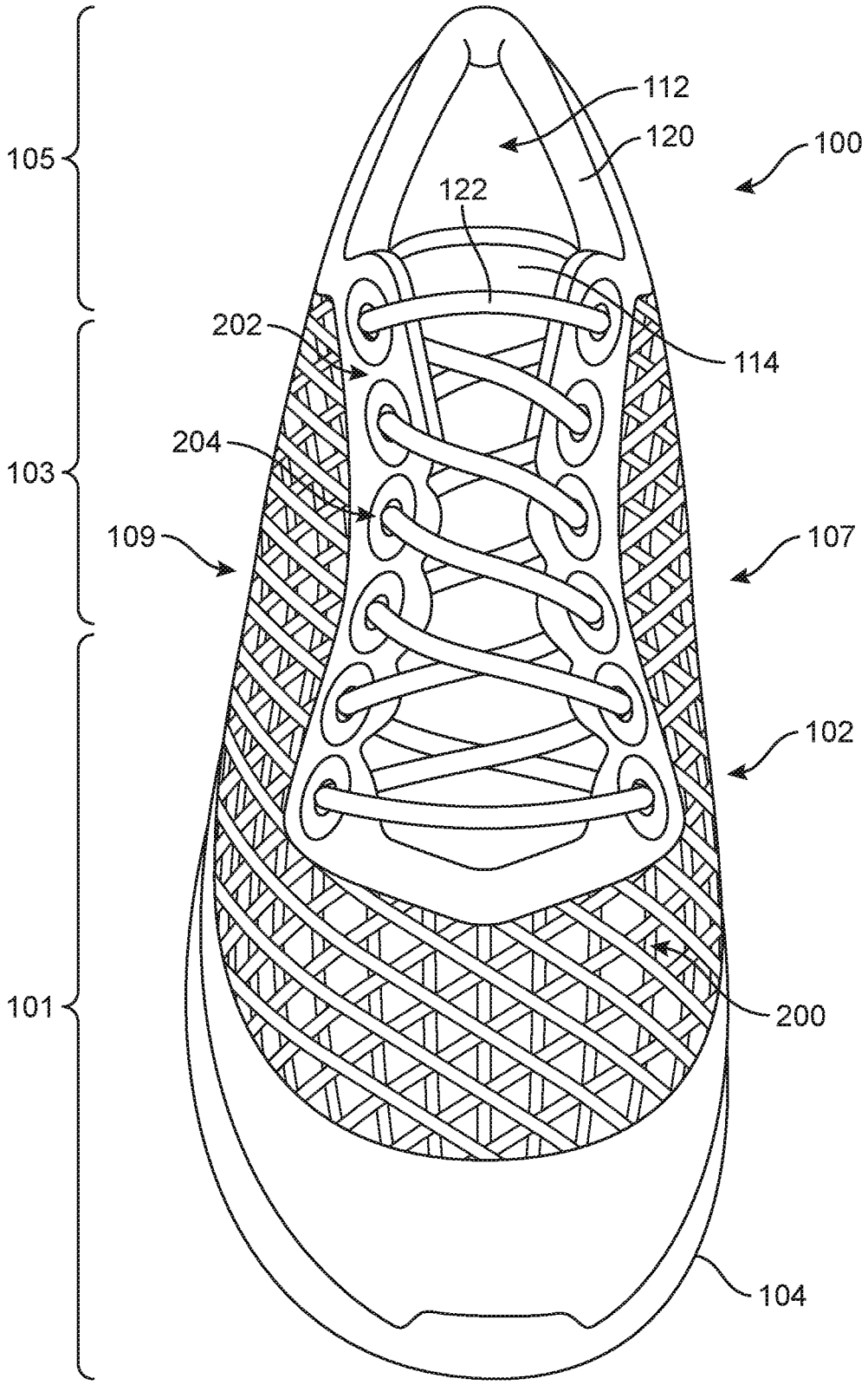
FIG. 1 is a schematic view of an embodiment of an article of footwear.

For purposes of general reference, as illustrated in FIG. 1, article of footwear 100 may be divided into three regions: forefoot region 101, midfoot region 103, and heel region 105. Forefoot region 101 may be generally associated with the toes and joints connecting the metatarsals with the phalanges. Midfoot region 103 may be generally associated with the arch of a foot, including the instep. Likewise, heel region 105 or "hindfoot" may be generally associated with the heel of a foot, including the calcaneus bone. For purposes of this disclosure, the following directional terms, when used in reference to an article of footwear, shall refer to the article of footwear when sitting in an upright position, with the sole facing the ground, that is, as it would be positioned when worn by a wearer standing on a substantially level surface.

The term "longitudinal," as used throughout this detailed description and in the claims, refers to a direction extending along the length of a component. For example, a longitudinal direction of an article of footwear extends from forefoot region 101 to heel region 105 of article of footwear 100. The term "forward" or "front" is used to refer to the general direction in which the toes of a foot point, and the term "rearward" or "back" is used to refer to the opposite direction, i.e., the direction in which the heel of the foot is facing.

The term "lateral direction," as used throughout this detailed description and in the claims, refers to a side-to-side direction extending along the width of a component. In other words, the lateral direction may extend between medial side 107 and lateral side 109 of article of footwear 100, with lateral side 109 of article of footwear 100 being the surface that faces away from the other foot, and medial side 107 being the surface that faces toward the other foot.

The term "vertical," as used throughout this detailed description and in the claims, refers to a direction generally perpendicular to both the lateral and longitudinal directions. For example, in cases where an article of footwear is planted flat on a ground surface, the vertical direction may extend from the ground surface upward. It will be understood that each of these directional adjectives may be applied to individual components of an article of footwear. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

It will be understood that the forefoot region, the midfoot region, and the heel region are only intended for purposes of description and are not intended to demarcate precise regions of an article of footwear. For example, in some cases, one or more of the regions may overlap. Likewise, the medial side and the lateral side are intended to represent generally two sides, rather than precisely demarcating an article of footwear into two halves. In addition, the forefoot region, the midfoot region, and the heel region, as well as the medial side and the lateral side, may also be applied to individual components of an article of footwear, including a sole structure, an upper, a lacing system, and/or any other component associated with the article.

Article of footwear 100 may include upper 102 and sole or "sole structure" 104 (see also FIG. 2), which define an internal cavity between the upper and sole. The "interior" of an article of footwear refers to space in this internal cavity that is occupied by a wearer's foot when the article of footwear is worn. The "inner side" or "inside" of an element refers to the face of that element that is (or will be) oriented toward the internal cavity in a completed article of footwear. The "outer side," "outside," or "exterior" of an element refers to the face of that element that is (or will be) oriented away from the internal cavity in the completed article of footwear 100. In some cases, the inner side of an element may have other elements between that inner side and the interior in the completed article of footwear 100. Similarly, an outer side of an element may have other elements between that outer side and the space external to the completed article of footwear 100. Further, the terms "inward" and "inwardly" shall refer to the direction toward the interior of the article of footwear, and the terms "outward" and "outwardly" shall refer to the direction toward the exterior of article of footwear 100.

Upper 102 provides a covering for the wearer's foot that comfortably receives and securely positions the foot with respect to the sole structure. In general, upper 102 includes opening 112 that provides entry for the foot into an interior cavity of upper 102 in heel region 105. Upper 102 may also include tongue 114 that provides cushioning and support across the instep of the foot. An upper may be of a variety of styles depending on factors such as desired use and required ankle mobility. For example, an athletic shoe with an upper having a "low-top" configuration extending below the ankle that is shaped to provide high mobility for an ankle. An upper could be configured as a "high-top" upper extending above the wearer's ankle for basketball or other activities, or as a "mid-top" configuration extending to about the wearer's ankle. Furthermore, an upper may also include non-athletic shoes, such as dress shoes, loafers, sandals, and work boots.

Upper 102 may also include other known features in the art including heel tabs, loops, etc. Furthermore, upper 102 may include a toe cage or box in the forefront region. Even further, upper 102 may include logos, trademarks, and instructions for care.

Upper 102 may include a fastener on a fastening region of the upper. For example, the fastening provision may be lacing system 122, or "lace," applied at a fastening region of upper 102. Other kinds of fastening provisions, include, but are not limited to, laces, cables, straps, buttons, zippers as well as any other provisions known in the art for fastening articles. For a lacing system, the fastening region may comprise one or more eyelets. The fastening region may comprise one or more tabs, loops, hooks, D-rings, hollows, or any other provisions known in the art for fastening regions.

Sole structure 104 is positioned between a foot of a wearer and the ground, and may incorporate various component elements. For example, sole structure 104 may include one or more of inner sole components or "insoles," a middle sole element or "midsole," and an outer sole element or "outsole." An insole may take the form of a sockliner adjacent the wearer's foot to provide a comfortable contact surface for the wearer's foot. It will be understood that an insole may be optional. Further, a midsole may directly serve as a cushion and support for the foot. In addition, an outsole may be configured to contact the ground surface.

Upper 102 and sole structure 104 may be coupled using any conventional or suitable manner, such as adhesion or bonding, via a woven connection, via one or more types of fasteners, etc. In some cases, a sole structure and an upper may be combined together in a single unitary construction.

Sole structure 104 may contact a ground surface and have various features to deal with the ground surface. Examples of ground surfaces include, but are not limited to, indoor ground surfaces such as wood and concrete floors, pavement, natural turf, synthetic turf, dirt, as well as other surfaces. In some cases, the lower portions of sole structure 104 may include provisions for traction, including, but not limited to, traction elements, studs, and/or cleats.

Sole structure 104 may be made of a variety of any suitable material or pluralities of materials for a variety of functions. For example, one or more components of sole structure 104, such as the midsole, may be formed from a polymer foam (e.g., a polyurethane or ethylvinylacetate foam) material that attenuates ground reaction forces (i.e., provides cushioning) during walking, running, and other ambulatory activities. In addition, the components of a sole may also include gels, fluid-filled chambers, plates, moderators, inserts, or other elements that further attenuate forces, enhance stability, or influence the motions of the foot. In addition, the other components may have specific surface properties, such as an outsole being made from a durable material, such as carbon or blown rubber, which is further textured to impart traction. Furthermore, the insole may be made from a waterproof material such as ethylvinylacetate to prevent moisture seeping into the sole.

For purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" shall refer to the joining of two components in a manner such that the two components are secured together, but may be readily detached from one another. Examples of removable attachment mechanisms may include hook and loop fasteners, friction fit connections, interference fit connections, threaded connectors, cam-locking connectors, and other such readily detachable connectors. Similarly, "removably disposed" shall refer to the assembly of two components in a non-permanent fashion.

The term "strand" includes a single fiber, filament, or monofilament, as well as an ordered assemblage of textile fibers having a high ratio of length to diameter and normally used as a unit (e.g., slivers, roving, single yarns, plies yarns, cords, braids, ropes, etc.). The term "thread" as used herein may refer to a strand used for stitching.

The embodiments discuss methods of embroidering or sewing one or more elements to a substrate. Embroidering an element to a substrate comprises stitching the element in place with a thread, yarn, or other strand of material.

The present application is directed to an upper including ribbon and portions or sections of ribbon. As used herein, the term "ribbon" refers to a long, narrow strip of material. In addition to the provisions described herein and shown in the figures, the embodiments may make use of any of the structures, components, and/or methods for articles with ribbon as disclosed in Luedecke et al., U.S. Ser. No. 15/648,638, filed Jul. 13, 2017 and titled "Article with Embroidered Tape Segments," the entirety of which is herein incorporated by reference.

Figure 2:
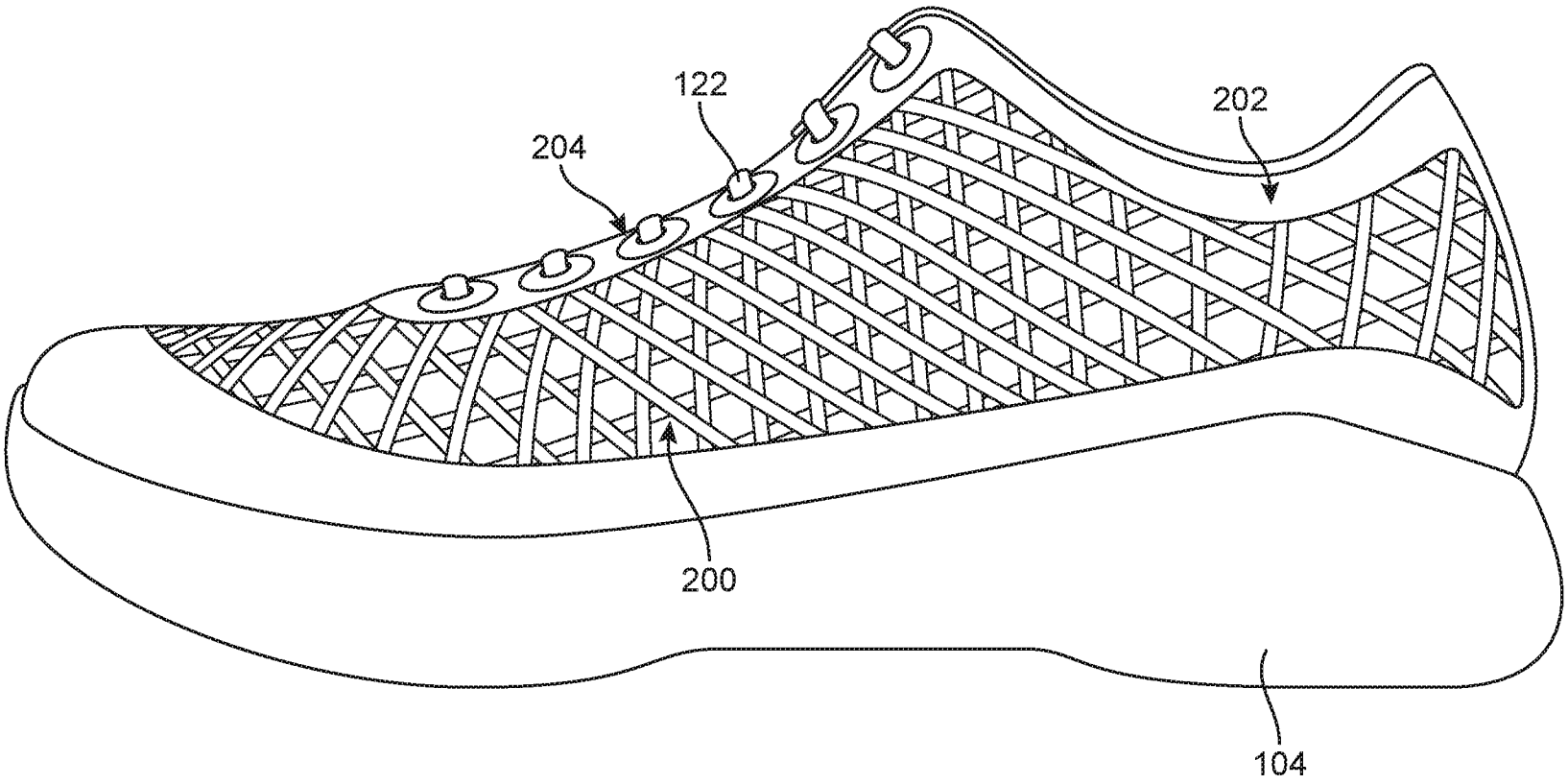
FIG. 2 is a schematic side view of an embodiment of an article of footwear.

FIG. 2 is a schematic side view of an embodiment of article of footwear 100. Referring to FIGS. 1-2, upper 102 may be comprised of ribbon structure 200, border element 202 and eyelet reinforcing elements 204. The term "ribbon structure," as used throughout this detailed description and in the claims, refers to any structure that is formed by attaching or otherwise arranging one or more ribbon pieces, sections, or portions into a structure on an upper. Ribbon structure 200 may extend through the entirety of upper 102. That is, ribbon structure 200 extends through forefoot region 101, midfoot region 103, and heel region 105 as well as through both medial side 107 and lateral side 109. In contrast, border element 202 may extend only on various edges or boundaries of upper 102. Border element 202 may extend along edges of upper 102 that are attached to sole structure 104 as well as along the periphery of opening 112.

While the exemplary embodiment includes eyelet reinforcing elements 204, other embodiments may not include reinforcing elements. In some cases, eyelets may be formed from openings in a border element.

Upper 102 may further include inner lining 120. Inner lining 120 could be any kind of lining known in the art for use in footwear. In some cases, inner lining 120 could be a knit or mesh lining. In still other cases, upper 102 may not include an inner lining and instead ribbon structure 200 could be a freestanding structure.

In some cases, ribbon sections could be separate segments or pieces (i.e., detached at their ends from one another). In other cases, ribbon sections could be part of a continuous ribbon with no natural boundary between adjacent sections.

Figure 19:
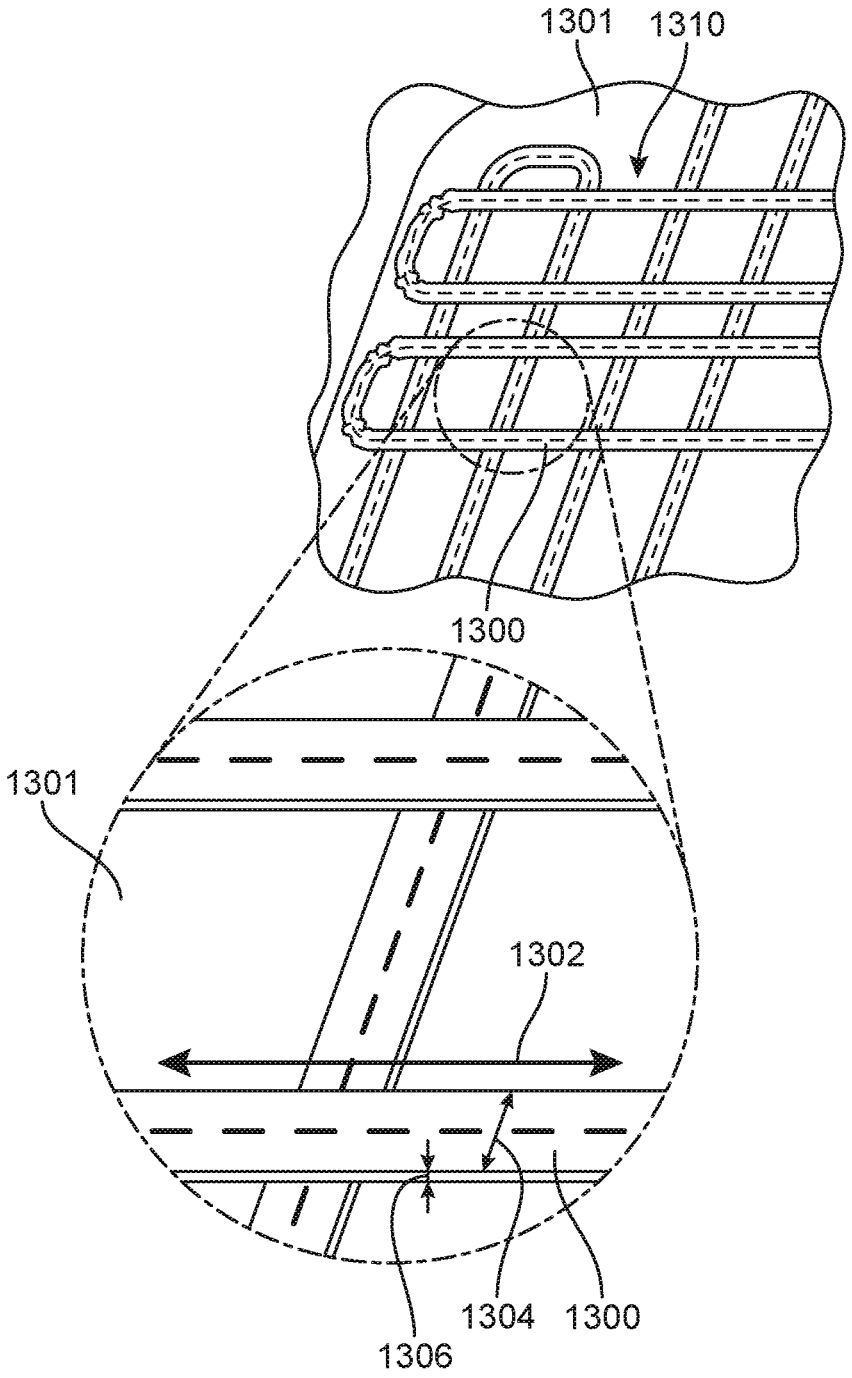
FIG. 19 is a schematic view of an embodiment of an article with an enlarged view of a region of a ribbon structure.

A ribbon may generally have a width that is greater than its thickness, giving the ribbon a two-dimensional appearance in contrast to threads or other strands that have a one-dimensional appearance. The dimensions of one or more ribbons could vary. For example, the thickness of a ribbon could vary in a range between approximately 0.2 millimeters and 1 millimeters. As another example, the width of a ribbon could vary in a range between approximately 2 millimeters and approximately 6 millimeters (e.g., 3 millimeters). If the width is substantially less than 2 millimeters the ribbon may be more difficult to stitch, weld, or otherwise attach to a backing layer or other element (e.g., another ribbon). If the width is substantially greater than 6 millimeters, the ribbon may tend to bend or fold with respect to a lengthwise direction, which may make attachment more difficult. The length of the ribbon may vary according to the particular pattern or design for an article and may generally be 10 millimeters or more. For purposes of clarity, FIG. 19 illustrates an exemplary embodiment of a ribbon 1300 with various dimensions. Ribbon 1300 has been stitched down to a backing layer 1301 as part of a ribbon structure 1310. Ribbon 1300 may have a lengthwise direction 1302. Ribbon 1300 may intersect one or more ribbon sections as it extends along lengthwise direction 1302. Ribbon 1300 also includes a width 1304 and a thickness 1306. In the embodiment of FIG. 19, width 1304 may be approximately 3 millimeters and thickness 1306 may be approximately 0.5 millimeters.

The material of one or more ribbons may vary. The ribbons may be formed of a generally flexible textile or fabric that resists elongation. The material could also be any material including a thermoplastic. Examples of thermoplastics include, but are not limited to: thermoplastic polyurethane (TPU), acrylic, nylon, polylactic acid (PLA), polyethylene, or acrylonitrile butadiene styrene (ABS) or ethylene vinyl acetate (EVA). Ribbons may be made from a foam, a film, and/or a composite with multiple layers—including polymer layers and fabric layers, for example.

A ribbon may be made of a material that undergoes little to no stretch under tension. This may help ensure the ribbon provides strength and support to parts of a foot along a tensioned direction. In some cases, the ribbon could stretch less than 40% of its pre-stretched length before inelastically deforming or before individual fibers begin to break. In some cases, the ribbon could stretch less than 20% of its pre-stretched length before inelastically deforming or before individual fibers begin to break. In one case, the ribbon could stretch less than 10% of its pre-stretched length before inelastically deforming or before individual fibers begin to break. That is, in one case, the ribbon could undergo elastic deformation of up to 10% of its pre-stretched length and return to its pre-stretched length without permanent change to its structure. To accommodate the stretch of a ribbon, the thread used to embroider or otherwise stitch the ribbon in place may be selected to have a degree of stretch that matches the degree of stretch of the ribbon, or which is greater than the degree of stretch of the ribbon.

Ribbons can have a knit, braided or woven construction. Ribbons could be made of a woven material that resists stretching. Moreover, the woven material may comprise a 0 and 90 degree weave arranged as a single layer.

Ribbons could be made of materials that expand under heat and/or pressure. Exemplary expanding materials include foam materials, expanding polymers, expanding films, and/or other expandable materials.

A border element 202 may extend around the edges or periphery of upper 102. Border element 202 may be an embroidered structure comprised of thread that has been stitched through ribbon structure 200 (as well as possibly other layers including a backing layer).

Border element 202 may comprise a continuous element that extends around the entire periphery of border element 202. Alternatively, border element 202 may be discontinuous and may have gaps along the periphery.

A border element may comprise threads stitched to another layer (e.g., a ribbon layer and/or a substrate/backing layer). A border element may comprise a standalone structure of threads that have been stitched together to form an interlocking matrix. The embroidered regions and/or structures of the present disclosure may utilize any of the structures, patterns, or features disclosed in Berns et al., U.S. Publication Number 2015/0272272, published on Oct. 1, 2015, filed on Mar. 25, 2015 as U.S. application Ser. No. 14/668,935, and titled "Footwear Including Textile Element," the entirety of which is herein incorporated by reference and referred to as the "Embroidered Structures Application."

As discussed in the Embroidered Structures Application, some embodiments may incorporate self-supporting embroidered structures with threads or yarns arranged in a matrix that lacks a backing or support layer. Such embroidered structures could be formed by first stitching threads to a backing layer and later removing the backing layer. The embodiments can use any of the methods for forming embroidered structures as disclosed in the Embroidered Structures Application.

Threads used for embroidery or other forms of stitching may be comprised from a variety of materials. For example, thread may be made of polymer materials including nylon, polyethylene, TPU, PVA, or EVA as well as Dyneema fiber made from Ultra-High Molecular Weight Polyethylene. Thread may also include a blend of polymer materials and may include nitrile rubber. Thread also may be made from more conventional materials including cotton, silk, or other natural fibers disclosed herein. Other materials that may be used include, but are not limited to, nylon, polyester, polyacrylic, polypropylene, polyethylene, metal, silk, cellulosic fibers, elastomers, etc. Thread also may be made from any known synthetic equivalent. In some cases, exposing the thread to heat or pressure may cause the thread to melt or fuse. In other cases, exposing the thread to heat or pressure may cause the thread to dissolve. In still other cases, the thread may dissolve when exposed to a solvent, such as acid or water.

Threads may be comprised of a material that stretches lengthwise under tension. For example, in some embodiments, a thread could be an elastic thread. As an example, an elastic thread comprised of 60-70% polyester and 30-40% polyurethane could be used.

A first kind of thread may be used to embroider or otherwise stitch ribbons in place on a backing layer or other substrate. In addition, one or more border elements may be formed by further stitching over the ribbons and/or substrate layers using a second kind of thread. In some cases, the first and second kinds of thread could be similar kinds of threads. In other cases, however, the first and second kinds of thread could be different kinds of threads. For example, in some cases, the first kind of thread used to embroider down ribbons may have a narrower diameter than the second kind of thread used to form one or more border elements. Additionally, in some cases, the first and second kinds of thread could have different colors with the first kind of thread having a color that matches the color of ribbons and the second kind of thread having a color that is different (but perhaps complimentary to) than the color of the ribbons.

A backing layer, or backer layer, may be used during the embroidery process. A backing layer, in general, provides a layer to which one or more elements may be stitched. In some embodiments, a backing layer may remain after manufacturing to provide, for example, an inner lining for an article. Alternatively, the backing layer may be melted into the article. A backing layer could also be separated from other elements of an article after embroidering one or more ribbon sections into place. For example, the backing layer could be dissolved. Some embodiments can include an optional backing layer that may be distinct from an inner lining of an upper.

The materials of backing layers may vary. Backing layers or sheets may be used as an anti-abrasion layer, and may be made of a material soft to the skin, such as silk or cotton, as well as synthetic-like equivalents such as nylon, or foam materials. Backing layers may be used to prevent an article from stretching during embroidery, and may be used from a harder more rigid substance, such as a sheet made from TPU, PVA, or EVA. Backing layers also may be made from a fusible material such as EV, or a dissolvable material such as TPU, PVA, or EVA. Furthermore, backing layers may combine various materials for different purposes for different sections. For example, a rigid dissolvable backing material may be used in combination with a soft permanent backing layer. The backing layer may include a mesh. More specifically, the mesh may be elastic. It may be appreciated that any of the materials described here for backing layers could be used for ribbons.

Figure 3:
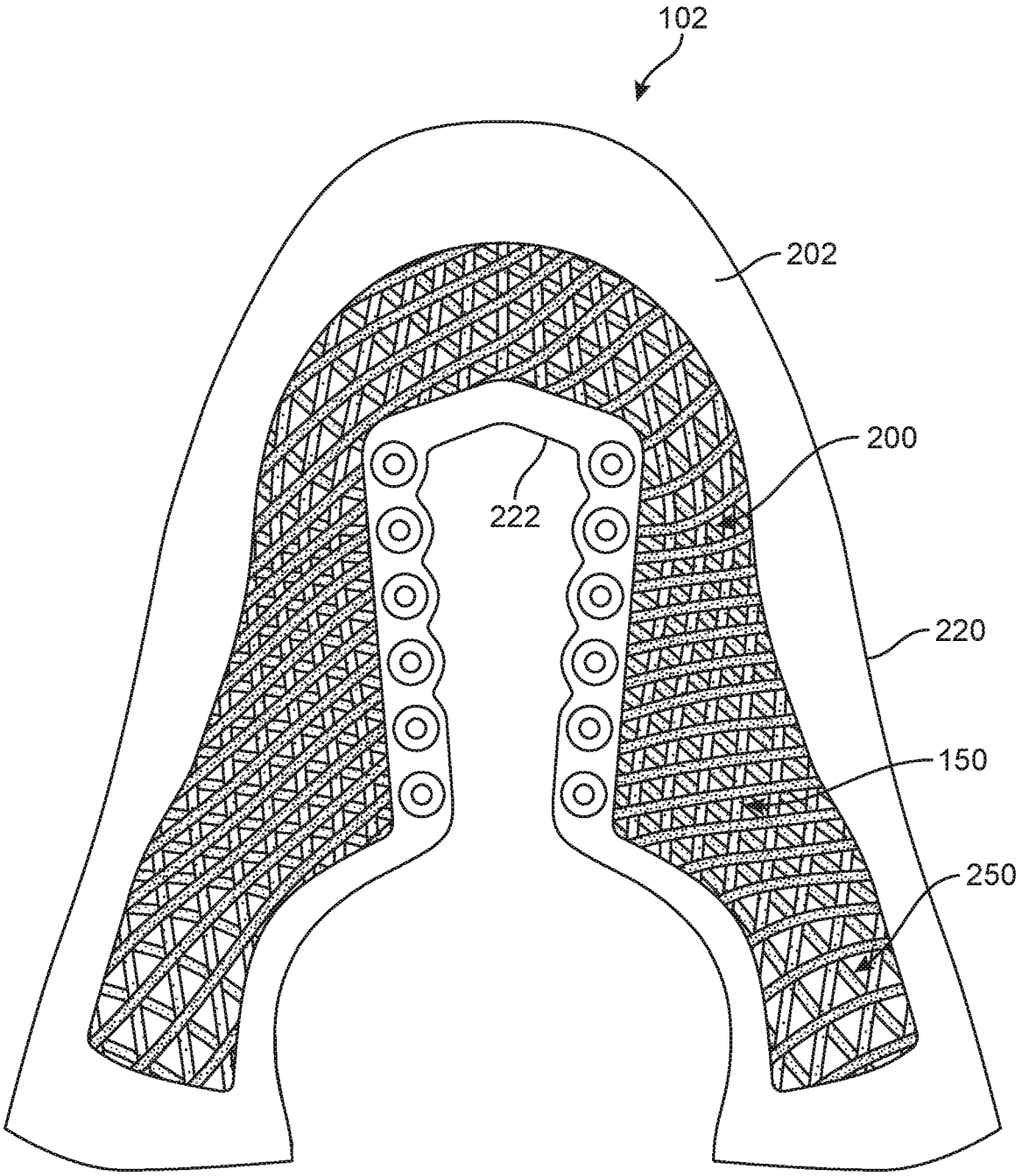
FIG. 3 is a top-down schematic view of an embodiment of an upper with a ribbon structure.

FIG. 3 is a schematic top-down view of upper 102 in a flattened configuration (i.e., in a configuration immediately following manufacturing of the upper but before the upper has been shaped and joined with sole structure 104).

Referring first to FIG. 3, upper 102 has outer peripheral edge 220 and inner peripheral edge 222. Inner peripheral edge 222 may extend around a lacing region of upper 102 as well as around other parts of a throat opening of upper 102. Outer peripheral edge 220 may be disposed adjacent a sole structure (e.g., sole structure 104 in FIGS. 1-2) when upper 102 is assembled with the sole structure. Upper 102 also includes an outer side (visible in FIG. 3) and an inner side (not shown). The inner side is the side of upper 102 that faces an interior foot receiving cavity of upper 102 while the outer side faces away from the interior foot receiving cavity.

With respect to these edges and sides, ribbon structure 200 extends substantially continuously throughout interior region 150 bounded by outer peripheral edge 220 and inner peripheral edge 222. In some cases, one or more continuous ribbons of ribbon structure 200 wind back and forth between inner peripheral edge 222 and outer peripheral edge 220. In the exemplary embodiment of FIG. 3, the entirety of ribbon structure 200 is comprised of a single continuous ribbon.

Also, in some cases, ribbon structure 200 extends along outer peripheral edge 220 and inner peripheral edge 222. Specifically, border element 202 extends along outer peripheral edge 220 and inner peripheral edge 222 but does not extend throughout the entirety of interior region 150.

Figure 4:
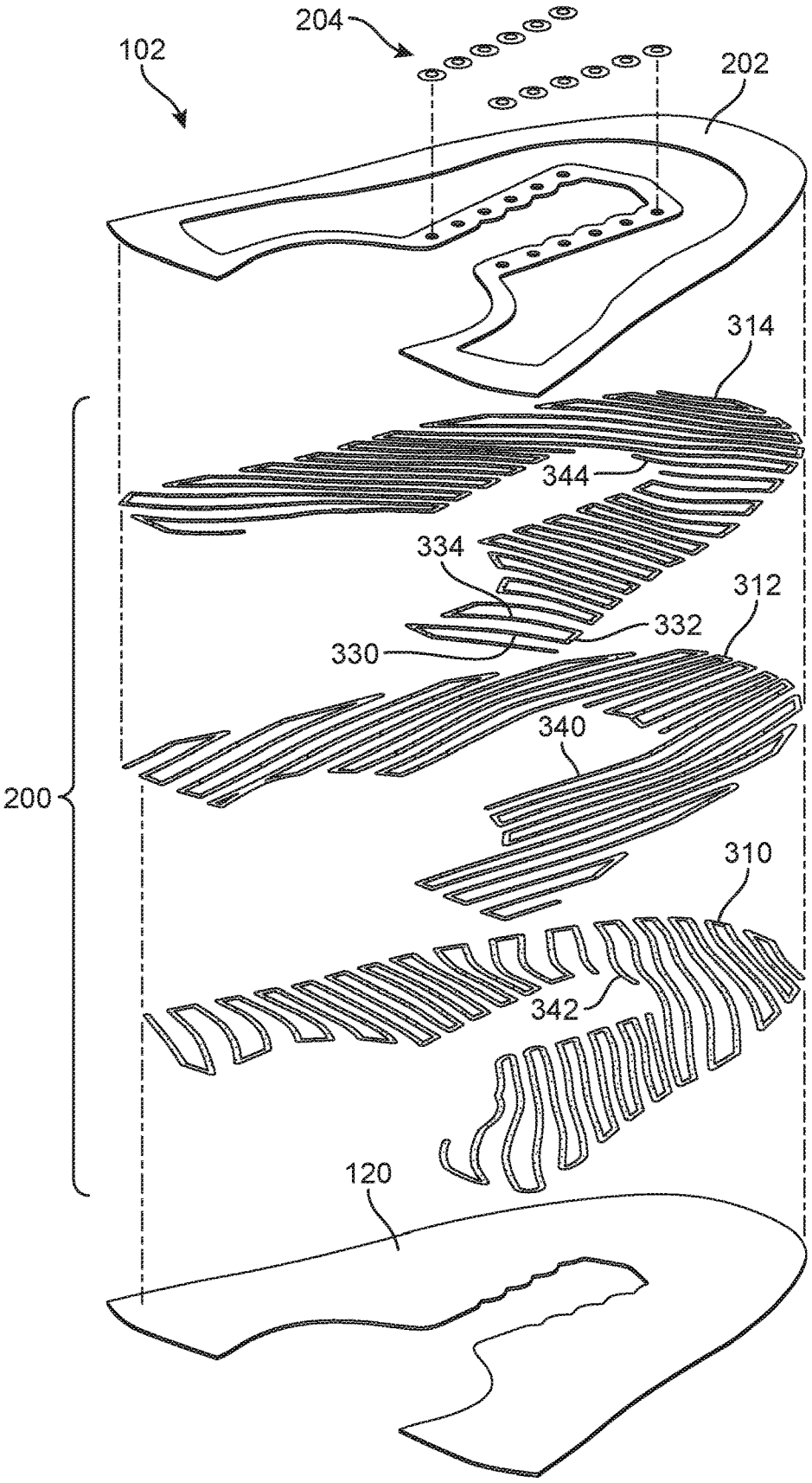
FIG. 4 is a schematic exploded view of the upper of FIG. 3.

FIG. 4 is an exploded isometric view of various layers of upper 102. Referring to FIG. 4, upper 102 includes border element 202, reinforcing eyelet reinforcing elements 204, ribbon structure 200, and inner lining 120. An optional backing or substrate layer may be disposed between ribbon structure 200 and inner lining 120 in some embodiments.

A ribbon structure could be comprised of a single layer. As used herein, a layer of ribbon refers to an arrangement of one or more ribbons along an approximately two-dimensional surface. A ribbon structure could be comprised of two or more ribbon layers. In the exemplary embodiment of FIG. 4, ribbon structure 200 is comprised of three layers including first (or inner) ribbon layer 310, second (or intermediate) ribbon layer 312, and third (or outer) ribbon layer 314.

In general, ribbons could be arranged in a variety of different patterns including, but not limited to, lattice patterns, grid patterns, web patterns, various mesh patterns as well as any other kinds of patterns. The type of pattern, including characteristics such as the spacing between adjacent ribbon sections, the sizes of ribbon sections (length, width, and thicknesses), and the relative arrangements of ribbon sections (stacked, woven, etc.), can be varied to achieve particular characteristics for the resulting structure including particular strength, flexibility, durability, weight, etc. It may be appreciated that using ribbons rather than cords can provide more positive engagement and more surface area to connect adjacent layers of ribbon. Furthermore, ribbons can be constructed with substantially small thicknesses so that the overall thickness of a ribbon structure can be kept substantially small, even when the ribbon structure is comprised of multiple ribbon layers.

Patterns may be formed by laying down ribbon sections in substantially straight and/or substantially curved paths within one or more layers. As used herein, a substantially straight ribbon path has a substantially higher radius of curvature than a substantially curved ribbon path.

Ribbon patterns within each layer may be created by laying down continuous ribbons in paths that have sections that are substantially straight and sections that are substantially curved. Patterns may include one or more "turns", or switchbacks, that result in a substantial change in the ribbon direction, thereby allowing the ribbons to wind (or weave) back and forth between the peripheral edges of the ribbon structure.

As an example, third ribbon layer 314 is comprised of three continuous ribbons that wind back and forth in a pattern bounded by the peripheral edges of upper 102. These continuous ribbons include both substantially straight ribbon sections (i.e., ribbon section 330) and substantially curved ribbon sections (i.e., ribbon section 332). Moreover, the curved ribbon sections are sections where the ribbon "turns" back and reverses directions (i.e., the curved ribbon sections form switchbacks). So, for example, one can follow ribbon section 330 along a first approximately lateral direction toward ribbon section 332. At ribbon section 332, the ribbon turns around and one can follow ribbon section 334 in a second approximately lateral direction away from ribbon section 332. Likewise, both of second ribbon layer 312 and first ribbon layer 310 are comprised of one or more continuous ribbons arranged in winding paths including both substantially straight sections and substantially curved sections.

Different ribbon layers may be associated with different orientations. That is, each layer may be comprised of straight ribbon sections that extend approximately along a single direction (or axis). For example, second ribbon layer 312 is comprised of straight ribbon sections 340 that are approximately oriented along a longitudinal direction of upper 102. Also, first ribbon layer 310 is comprised of straight ribbon sections 342 that extend along various non-longitudinal directions. Likewise, third ribbon layer 314 also is comprised of straight ribbon sections 344 that extend along various non-longitudinal directions. It may be appreciated that the orientations of ribbon sections within a layer may vary. However, in some cases, the orientations of ribbon sections in different layers could vary in a predetermined manner so that the relative orientations of the different layers are preserved throughout different regions of an upper.

The orientations of the ribbon sections in each of first ribbon layer 310, second ribbon layer 312, and third ribbon layer 314 may be selected so that when these layers are assembled they form a triaxial pattern, as clearly seen in FIGS. 1-3. This triaxial pattern is created since locally the ribbon sections of each of the three ribbon layers are oriented in three approximately distinct directions. The resulting gaps or openings formed between adjacent strands have a distinct triangular geometry (e.g., triangular gap 250 in FIG. 3).

The geometry of a ribbon structure may vary with different patterns, including variations in the number of layers, orientations of strands and relative spacing between ribbon sections being selected according to intended uses of an article. A ribbon structure comprising ribbon sections that are attached at various intersection points may provide improved flexibility, comfort, and reduce pressure points when compared to conventional upper materials. As a specific example, a triaxial ribbon pattern may be useful for distributing stresses along three distinct directions, thereby reducing the stress in any single direction.

As seen in FIG. 4, the various turns or curved ribbon sections form open-loops or partial-loops in ribbon sections along the peripheral edges of each ribbon layer and of upper 102. Moreover, when border element 202 is added to ribbon structure 200, these partial-loops may be covered and hidden from view.

Figure 5:
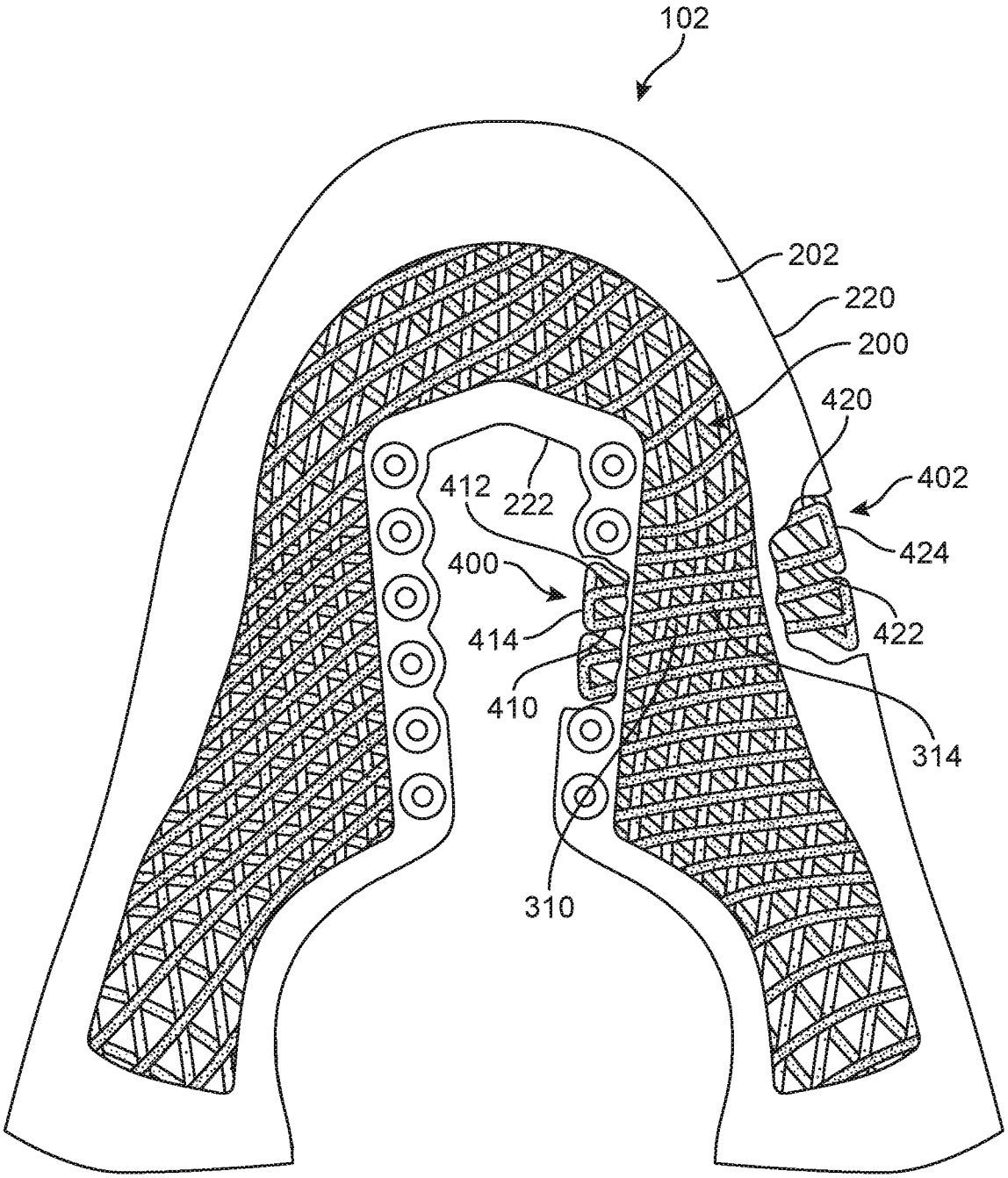
FIG. 5 is a schematic top-down view of an upper in which a portion of a border element is removed, according to an embodiment.

FIG. 5 is a schematic view of upper 102 with two cut-away sections: first cutaway section 400 and second cutaway section 402. Referring to FIG. 5, first cutaway section 400 is a section of upper 102 where a portion of border element 202 has been removed so that the underlying portions of ribbon structure 200 are visible along inner peripheral edge 222. Likewise, second cutaway section 402 is a section of upper 102 where a portion of border element 202 has been removed so that the underlying portions of ribbon structure 200 are visible along outer peripheral edge 220. For purposes of illustration only, small peripheral portions of the outer and inner peripheral edges of ribbon structure 200 are shown, but it may be understood that the entirety of the periphery of ribbon structure 200 is similar in configuration to these peripheral portions.

Within first cutaway section 400, a first partial-loop is shown comprising several sections of third ribbon layer 314: First straight ribbon section 410, second straight ribbon section 412, and curved ribbon section 414. Similar partial-loops of first ribbon layer 310 are also visible within first cutaway section 400.

Within second cutaway section 402, another partial-loop is shown comprising several sections of third ribbon layer 314: Third straight ribbon section 420, fourth straight ribbon section 422, and curved ribbon section 424. Similar partial-loops of first ribbon layer 310 are also visible within second cutaway section 402.

The partial-loops of ribbon structure 200 extending along inner peripheral edge 222 may correspond with the locations of eyelets in upper 102. This configuration is described in further detail below. However, in other cases, the partial-loops may not correspond with the locations of eyelets in an upper.

Thus, as seen in FIG. 5, border element 202 acts to cover the partial-loops located along the periphery of upper 102. With this arrangement, the visible portions of ribbon structure 200 have a near uniform and continuous triaxial pattern. Moreover, border element 202 may further act to smooth the surface along the periphery of upper 102, as described in further detail below.

A ribbon structure may be formed by attaching one or more ribbon layers to a backing layer. The ribbon layers may each be embroidered to the backing layer. Specifically, a first ribbon layer may be embroidered onto a backing layer. Then, a second ribbon layer may be embroidered onto the first ribbon layer and the backing layer. Then, a third ribbon layer may be embroidered onto the second ribbon layer, the first ribbon layer, and the backing layer.

Ribbons can be attached to substrate materials using any of the principles, methods, systems, and teachings disclosed in any of the following applications: Berns et al., U.S. Patent Application Publication Number 2016/0316856, published Nov. 3, 2016 and titled "Footwear Upper Including Strand Layers"; Berns et al., U.S. Patent Application Publication Number 2016/0316855, published Nov. 3, 2016 and titled "Footwear Upper Including Variable Stitch Density"; and Berns et al., U.S. Patent Application Publication Number 2015/0272274, published Oct. 1, 2015 and titled "Footwear Including Textile Element," the entirety of each application being herein incorporated by reference. Embodiments can use any known systems and methods for feeding ribbon to an embroidery or sewing machine including any of the systems and/or methods described in Miyachi et al., U.S.

Pat. No. 5,673,639, issued Oct. 7, 1997 and titled "Method of feeding a piece of tape to a belt loop sewing machine and tape feeder for effecting same," the entirety of which is herein incorporated by reference.

The technique of stitching the ribbon sections to a substrate may vary. The stitch technique used may include chain stitch, double chain stitch, the buttonhole or blanket stitch, the running stitch, the satin stitch, the cross stitch, or any other stitch technique known in the art. A combination of known stitch techniques may also be used. These techniques may be used individually or in combination to stitch either individual ribbon sections or groups of ribbon sections in place. Moreover, the stitch length can also be varied.

The stitches may form a pattern. When the stitching is performed by a machine, the machine may use a computer-generated program to control the stitching, including the locations of the stitching relative to an underlying substrate, as well as how and which ribbon sections to feed, how to stitch the ribbon sections, and the technique of stitching used.

In some cases, only a single type of ribbon is stitched using a machine. In other cases, multiple types of ribbon may be stitched using the same ribbon-feeding assembly. In still other cases, an embroidery device may have multiple feeding assemblies to embroider multiple ribbon sections at the same time.

The method of stitching used to attach one or more ribbon sections may vary. The thread could be stitched around a ribbon section, thereby securing the ribbon in place on a substrate layer. That is, the thread could be stitched to the backing layer on one side of the ribbon section, passed over the opposing side of the ribbon section and then stitched to the backing layer, such that the stitch never passes through the ribbon section. Alternatively, thread could be stitched directly through a ribbon section. A ribbon section could have preconfigured holes for receiving stitches. Alternatively, a needle may pierce a ribbon section to place a stitch through the ribbon section.

FIGS. 6-9 illustrate schematic views of a process for laying down and embroidering sections of ribbon. FIGS. 6-9 depict an embodiment comprising a portion of backing layer 500, as well as some ribbon sections of first ribbon layer 502. In addition, FIGS. 6-9 illustrate steps in a process of laying down and embroidering ribbon sections from second ribbon layer 504 onto the backing layer 500 as well as over portions of first ribbon layer 502. For clarity, only two ribbon layers are shown; however, similar principles may be applied for embodiments comprising three or more layers.

Figure 6:
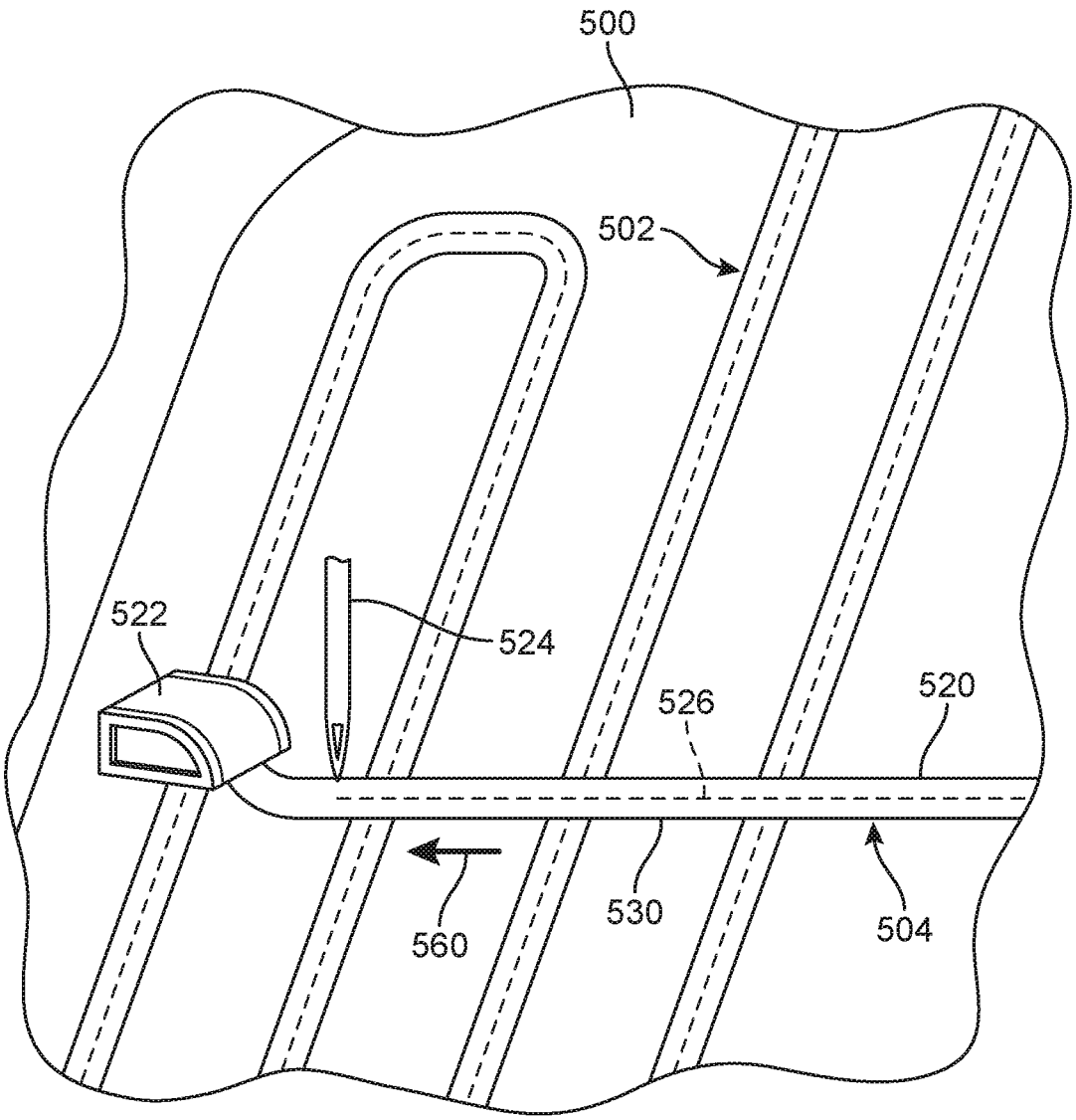
FIG. 6 is a schematic view of a process of forming a portion of an upper including multiple ribbon elements, according to an embodiment.

As seen in FIG. 6, ribbon 520 may be laid down on backing layer 500 (and across portions of first ribbon layer 502) using ribbon feeder 522. As ribbon 520 is laid down, embroidery needle 524 stitches thread 526 through ribbon 520 to fix ribbon 520 in place with respect to backing layer 500 and first ribbon layer 502. For purposes of illustration, both ribbon feeder 522 and embroidery needle 524 are shown schematically. Moreover, only the top thread (thread 526) is illustrated, though a bobbin thread may be disposed on an opposing side of backing layer 500. Thus it may be appreciated that the process of embroidering a ribbon section in place may include looping a top thread around a bobbin thread (or vice versa).

Figure 7:
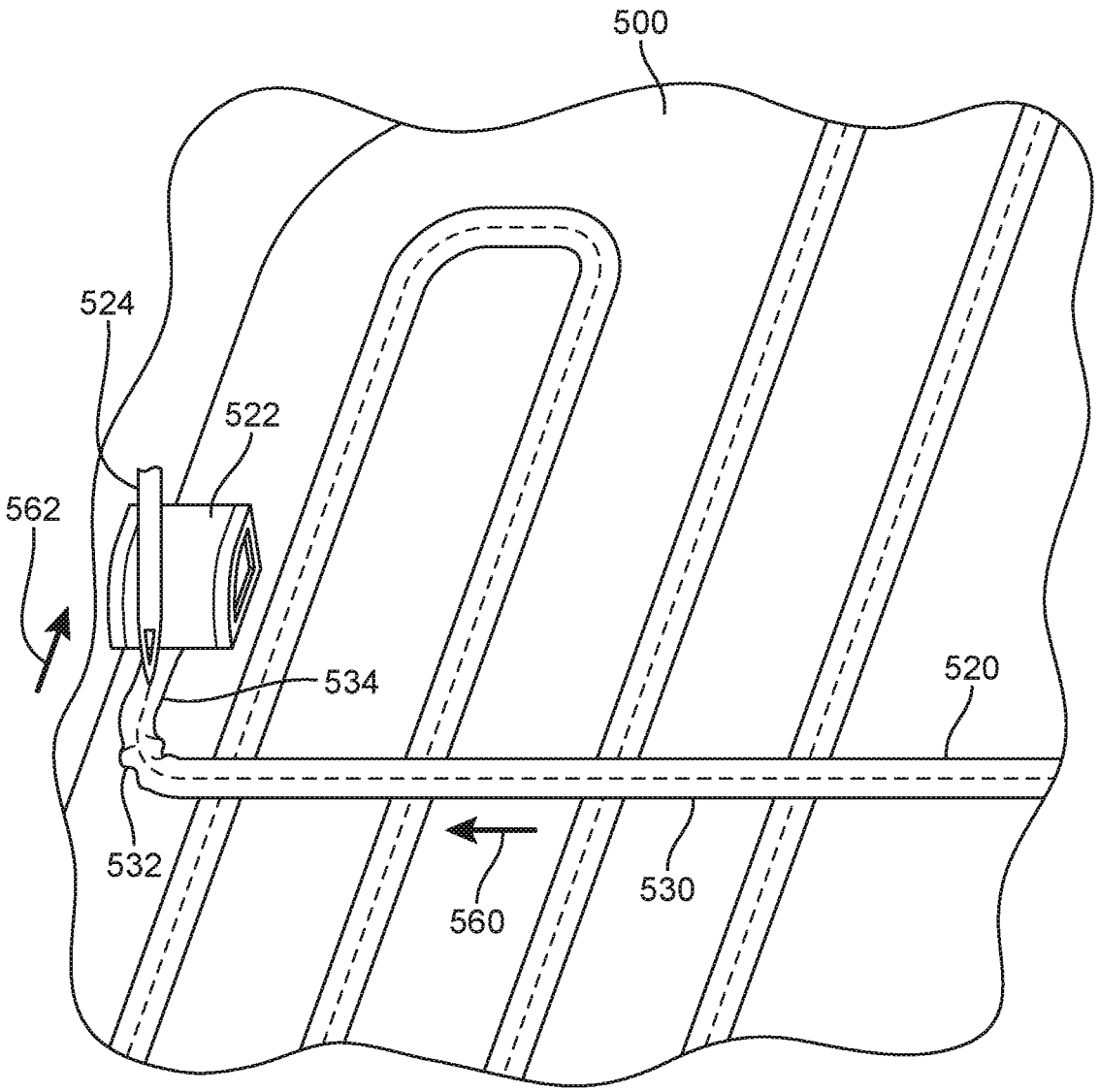
FIG. 7 is a schematic view of the process of FIG. 6 in which a ribbon feeder has turned as it lays down ribbon.

In FIG. 6, straight ribbon section 530 is laid down along first direction 560 and stitched in place. Next, as seen in FIG. 7, ribbon feeder 522 turns to form first corner section 532 and continues in second direction 562 to form intermediate straight section 534. As seen in FIG. 7, second direction 562 is oriented approximately perpendicular to first direction 560. Following this, as seen in FIG. 8, ribbon feeder 522 turns again to form second corner section 536 and then continues in third direction 564 that is parallel (and opposite to) first direction 560 to form another straight section 538.

Figure 8:
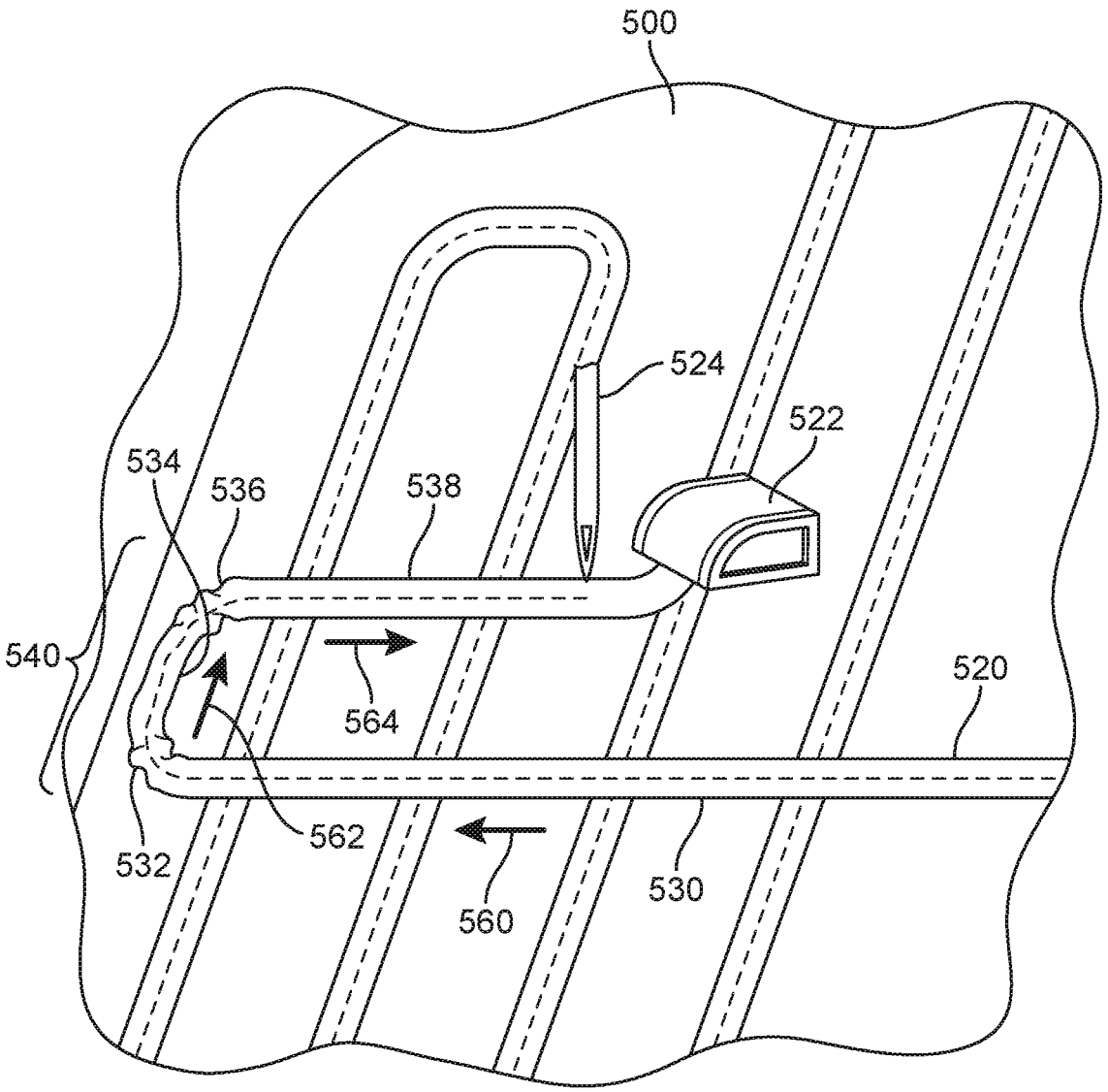
FIG. 8 is a schematic view of the process of FIG. 6 in which an open loop has been formed in a layer of ribbon, according to an embodiment.

As seen in FIG. 8, together first corner section 532, intermediate straight section 534, and second corner section 536 collectively form curved section 540 of ribbon 520. Moreover, although curved section 540 is comprised of corner sections and a straight intermediate section, other curved sections having a semicircular, elliptic, or any other kind of curvature could be used.

As ribbon sections are curved, they may undergo various kinds of distortion, such as folding, bending, buckling, ruffling, pinching, and/or other kinds of deviations from the natural geometry of a straight ribbon section. Depending on the type of tension applied along a corner section, the ribbon could deform in various ways. In some cases, the inner edge of the curved section may tend to bunch or pinch, and the outer edge of the curved section may stretch and even pop up out of the plane of the ribbon layer. In other cases, curved portions may simply develop ruffles or folds along one or both of the inner and outer edges.

Figure 9:
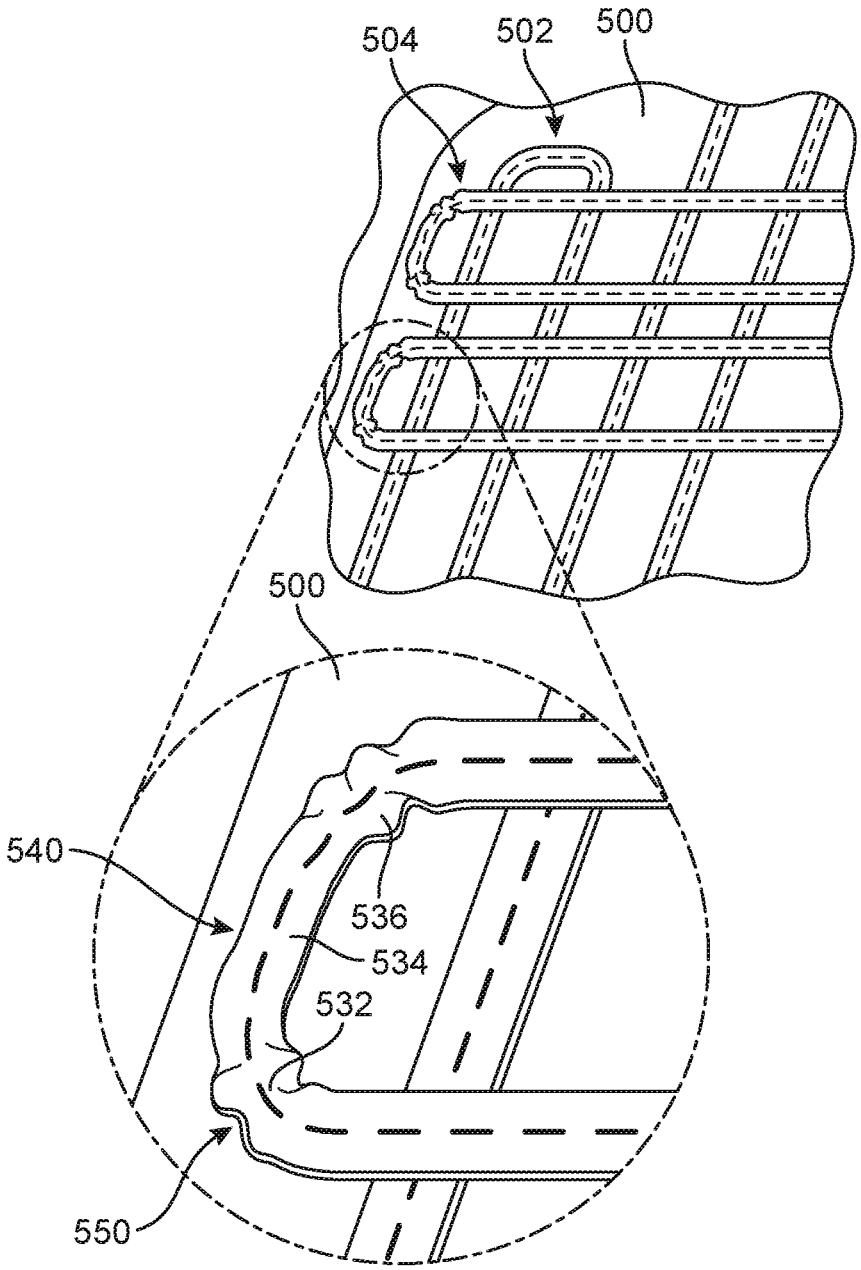
FIG. 9 is a schematic view of an embodiment of a portion of a ribbon structure including an enlarged view of a curved ribbon section that has ruffled.

FIG. 9 is a schematic view showing a portion of backing layer 500, first ribbon layer 502 and second ribbon layer 504. As seen in the enlarged view of FIG. 9, curved section 540 tends to buckle or ruffle as it resists curving along first corner section 532 and second corner section 536. This buckling or ruffling creates raised portions 550 (or folds) that bend up and away from backing layer 500.

Although FIG. 9 illustrates only two curved sections that undergo this distortion (e.g., buckling/ruffling), it may be appreciated that in some cases any and/or all curved sections in a ribbon structure may undergo similar buckling/ruffling.

The ruffling along the curved ribbon sections may create an uneven surface along the periphery of an upper. Some embodiments may therefore include provisions that help create a smoother peripheral surface.

Figure 10:
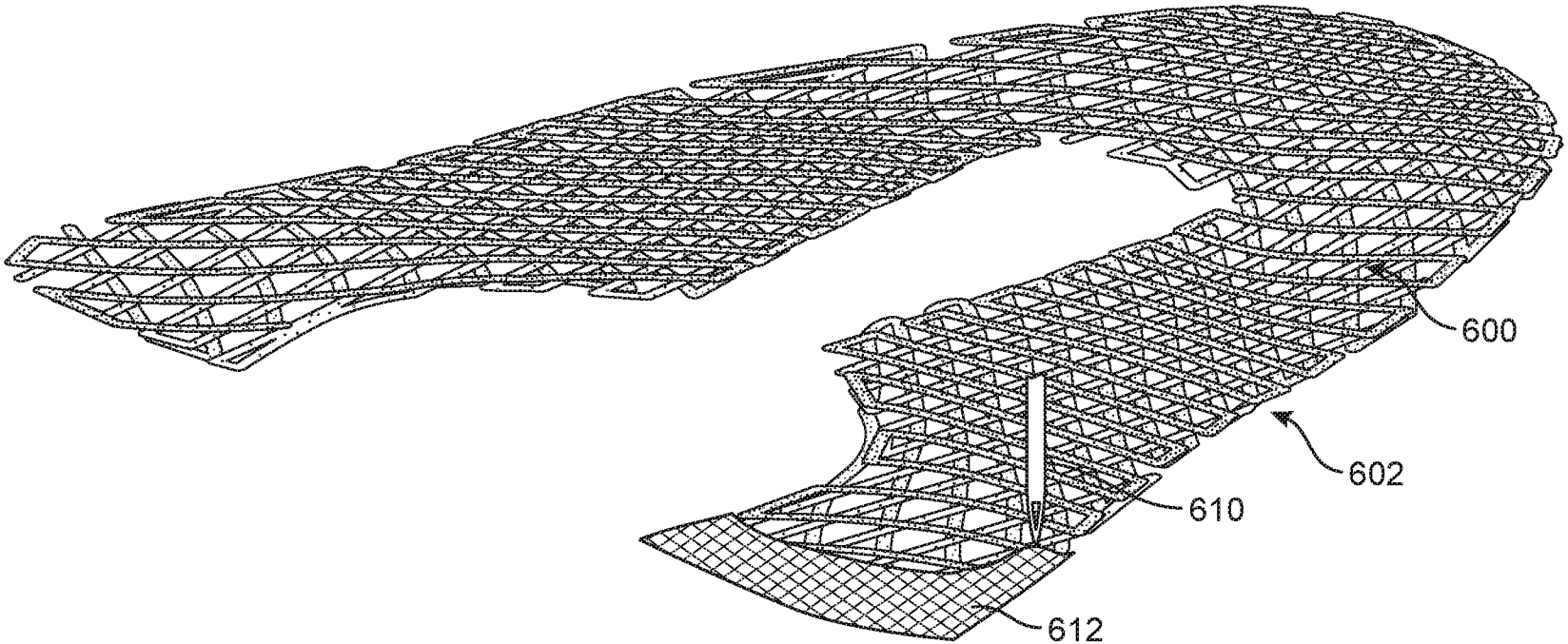
FIG. 10 is a schematic view of a process of embroidering a border element onto a ribbon structure, according to an embodiment.

FIG. 10 is a schematic view of a step of embroidering a border onto peripheral portion 602 of ribbon structure 600. In this case, embroidery needle 610 is used to form embroidered border element 612.

Figure 11:
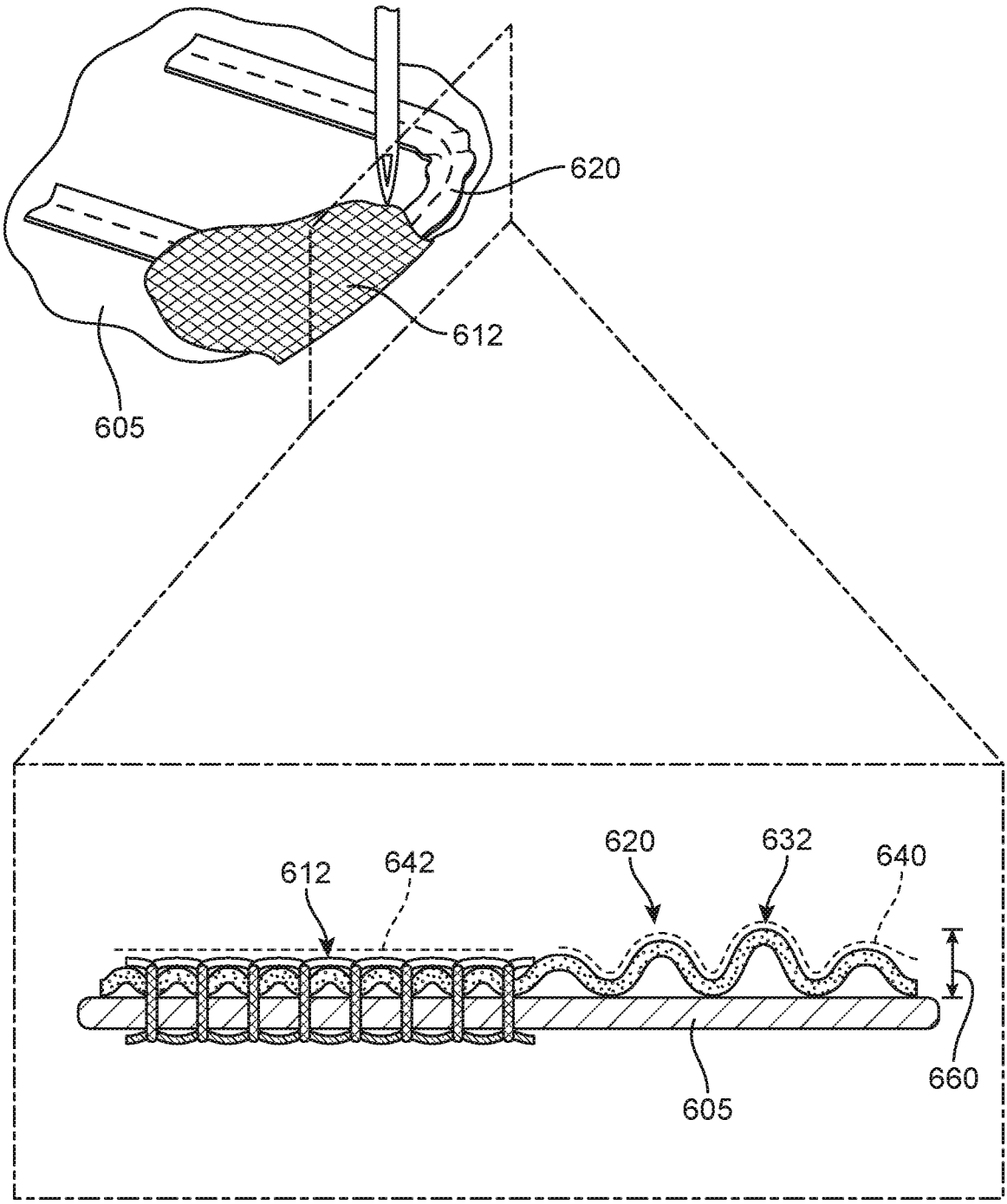
FIG. 11 is a schematic view of a process of embroidering a portion of a border element onto a curved ribbon structure, according to an embodiment.
Figure 12:
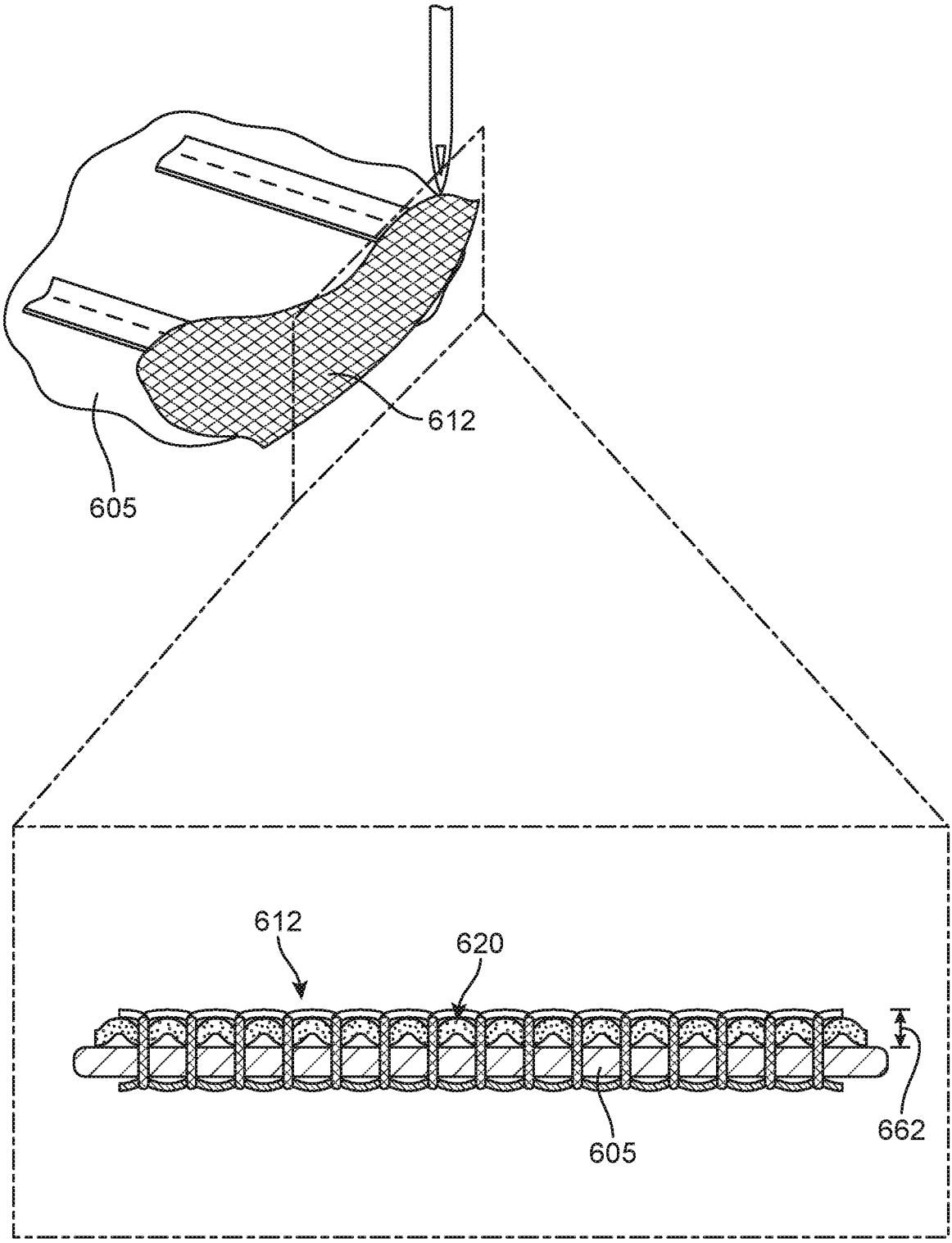
FIG. 12 is a schematic view of a process of embroidering a portion of a border element onto a curved ribbon structure, according to an embodiment.

FIGS. 11 and 12 illustrate schematic views of single curved ribbon section 620 as embroidered border element 612 is formed over single curved ribbon section 620. In the view shown in FIG. 11, approximately half of single curved ribbon section 620 has been embroidered over. As seen in FIG. 11, the exposed portion of single curved ribbon section 620 includes raised portions 632 that extend up and away from backing layer 605. These raised portions 632 form irregular surface 640. However, raised portions 632 of curved ribbon section 620 has been tacked down against backing layer 605 and has an approximately smooth and flat surface 642. After completing the embroidery of curved ribbon section 620, as seen in FIG. 12, the entire outer surface of this region is seen to be smooth.

Moreover, it may be seen by comparing FIGS. 11 and 12 that the maximum height that curved ribbon section 620 extends from backing layer 605 is reduced after curved ribbon section 620 is embroidered over (with border element 612). As seen in FIG. 11, prior to being covered by border element 612, curved ribbon section 620 has maximum height 660 (with respect to backing layer 605). After the embroidery is completed in FIG. 12, curved ribbon section 620 has maximum height 662 that is substantially less than maximum height 660. That is, the act of embroidering over curved ribbon section 620 pushes down the raised portions 632 of curved ribbon section 620.

Figure 13:
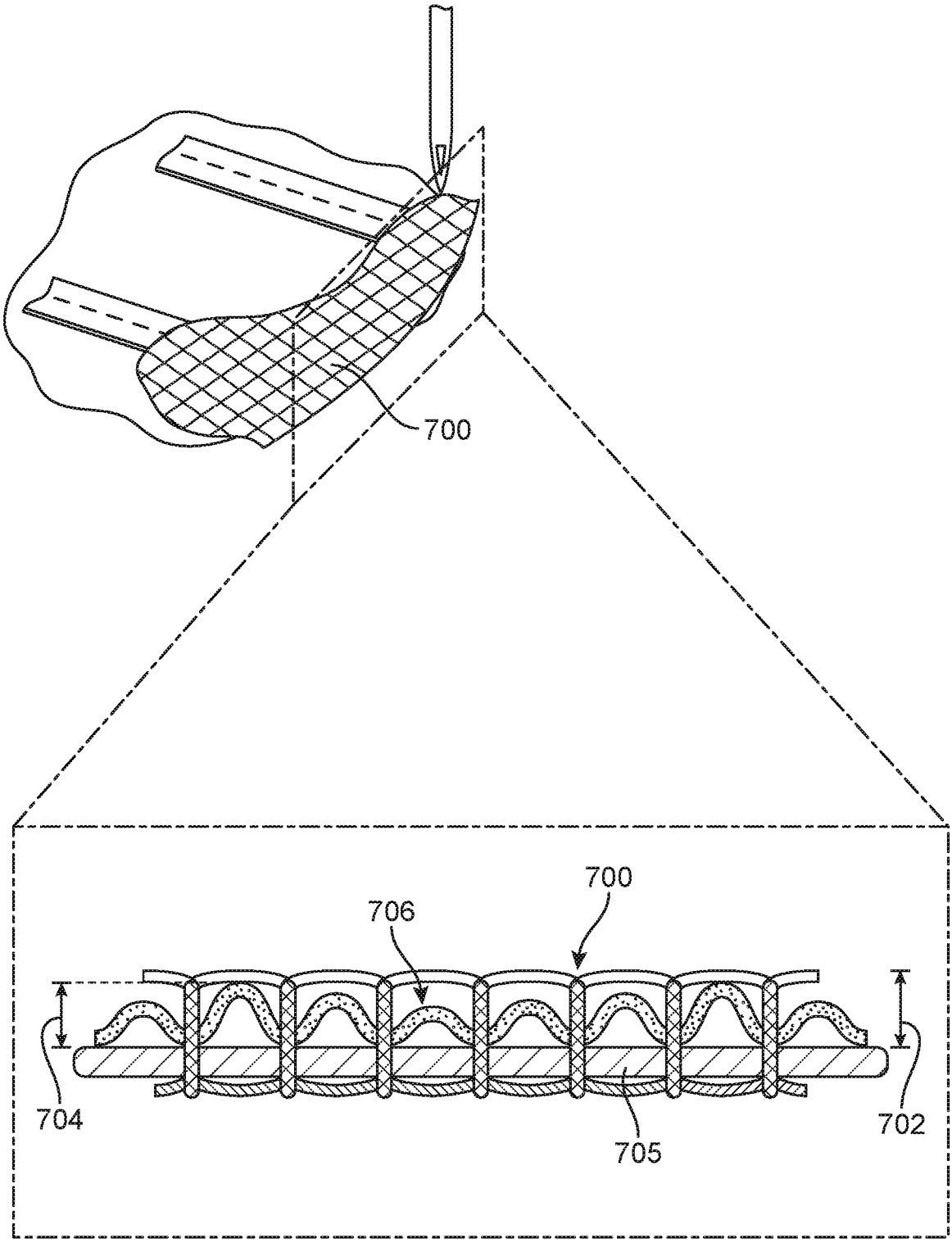
FIG. 13 is a schematic view of a process of embroidering a portion of a border element onto a curved ribbon structure, according to another embodiment.

Alternatively, in another embodiment, rather than acting to "tack down" the raised portions of a curved ribbon section, an embroidered border element could be formed with substantially long stitches that extend higher from a backing layer than any portions of the ribbon. For example, FIG. 13 is a schematic view of an embodiment where embroidered border element 700 covers ribbon section 706. As seen in the enlarged view, embroidered border element 700 has stitch height 702 (above backing layer 705) that is greater than or equal to maximum height 704 of any portions of ribbon section 706.

Curved ribbon sections may provide additional functionality along the periphery of an article of footwear. For example, curved ribbon sections may be used to form lace loops for an article of footwear.

Figure 14:
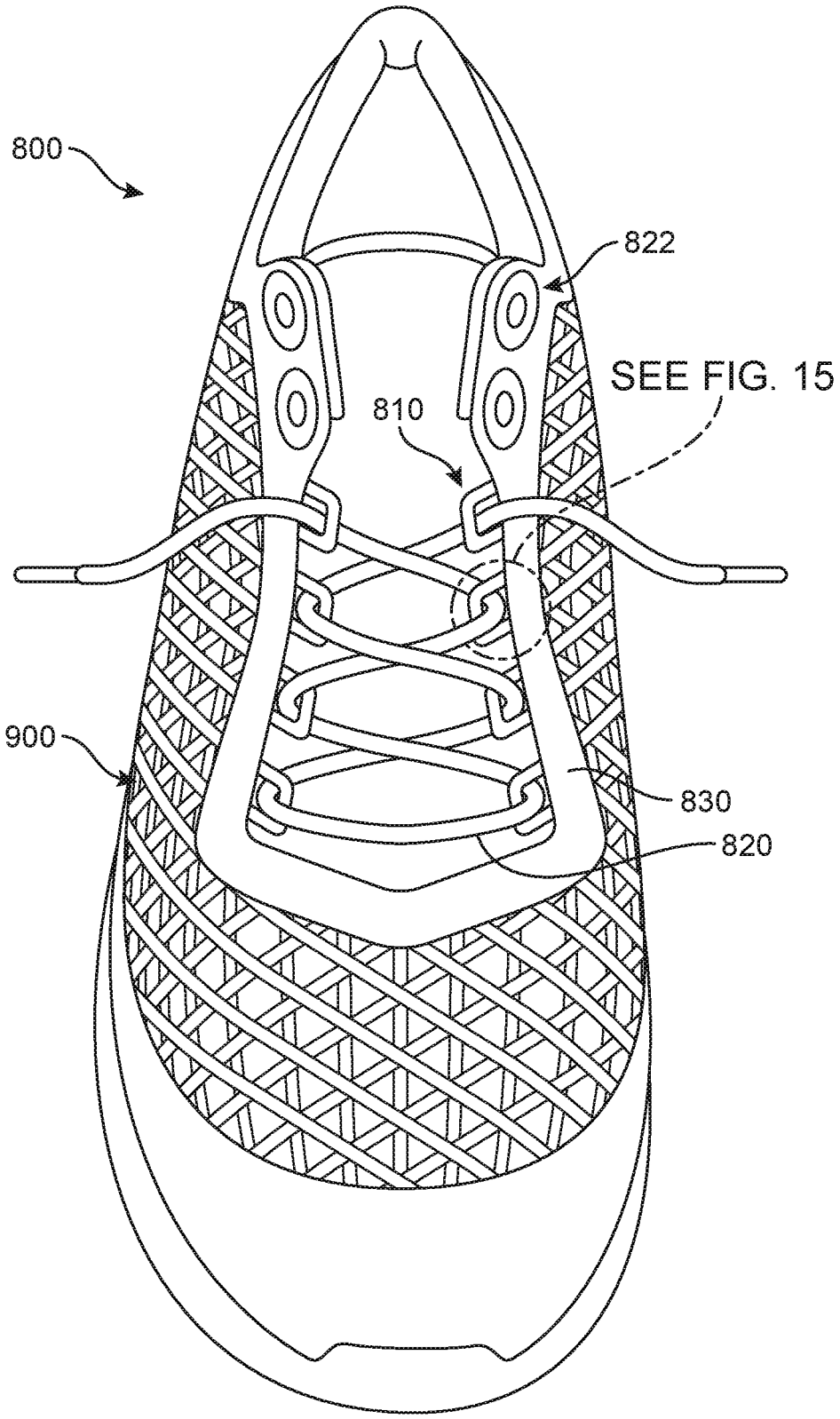
FIG. 14 is a schematic view of an embodiment of an article of footwear including a ribbon structure with lace loops.

FIG. 14 is a schematic view of an embodiment of article of footwear 800. Article of footwear 800 may be similar in one or more respects to article of footwear 100 of FIGS. 1-2. In some cases, article of footwear 800 may include ribbon structure 900 that is similar to ribbon structure 200, including ribbon sections arranged in a similar triaxial pattern. In contrast to article of footwear 100, however, article of footwear 800 may incorporate plurality of lace loops 810 that are formed from curved sections of ribbon. These lace loops may accommodate lace 820. In some cases, article of footwear 800 may also include additional eyelets 822.

Figure 15:
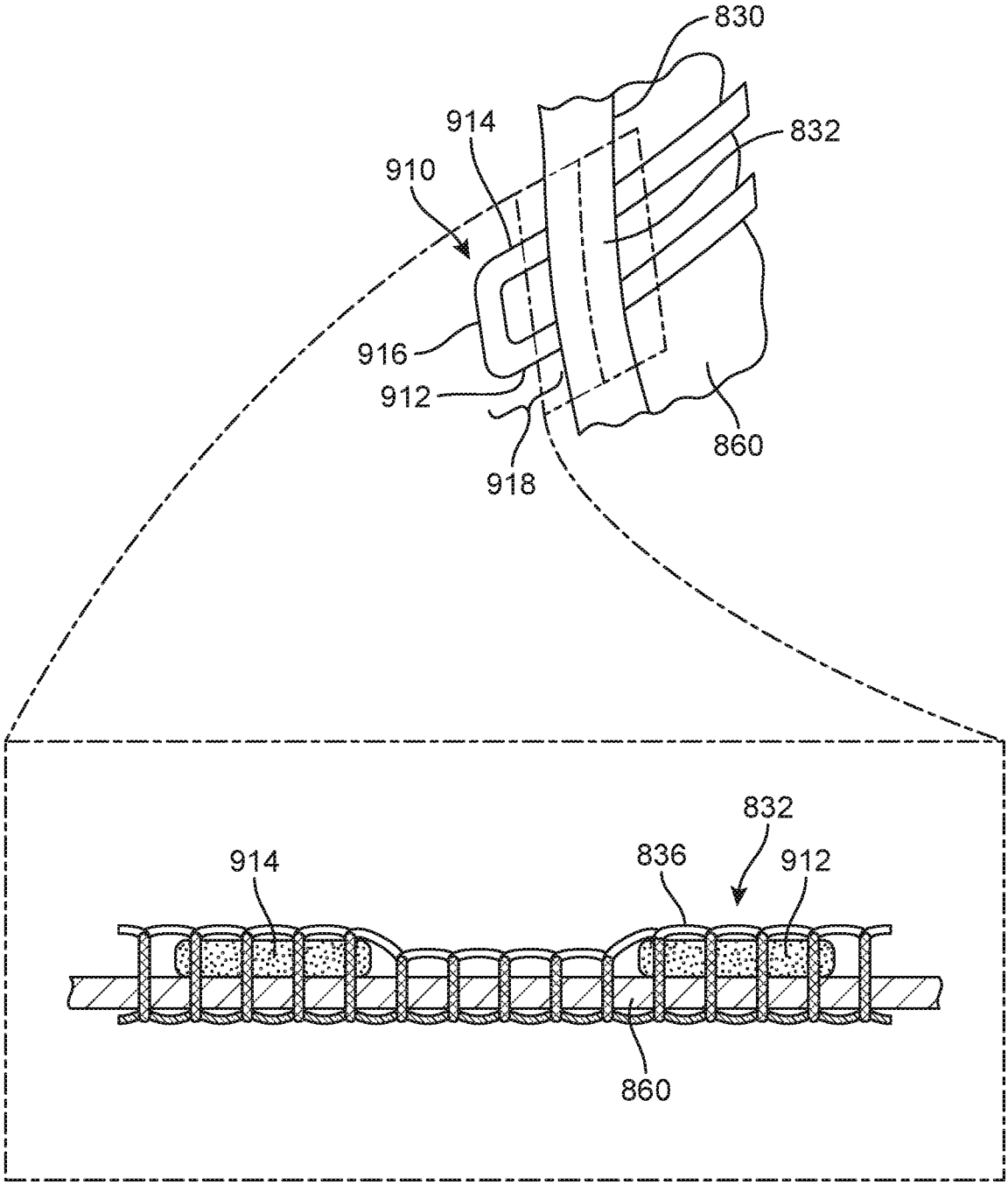
FIG. 15 is a schematic view of a portion of a ribbon structure including an open loop with an embroidered portion, according to an embodiment.

As seen in FIG. 15, closed lace loop 910 is comprised of first straight ribbon section 912, second straight ribbon section 914, and curved ribbon section 916. Together, these sections form open loop portion 918. In addition, portion 832 of border element 830 intersects first straight ribbon section 912 and second straight ribbon section 914, but does not cover open loop portion 918. Thus, portion 832 and open loop portion 918 together form closed lace loop 910 that retains lace 820.

As seen in the enlarged cross-sectional view of FIG. 15, stitches 836 of portion 832 extend through both first straight ribbon section 912 and second straight ribbon section 914 to fix portion 832 in place with respect to first straight ribbon section 912 and second straight ribbon section 914. The ribbon sections and border element 830 are both stitched to backing layer 860. However, it may be appreciated that a backing layer is optional and in other cases a self-supporting embroidered structure, including those discussed above, could be used without a backing layer.

Figure 16:
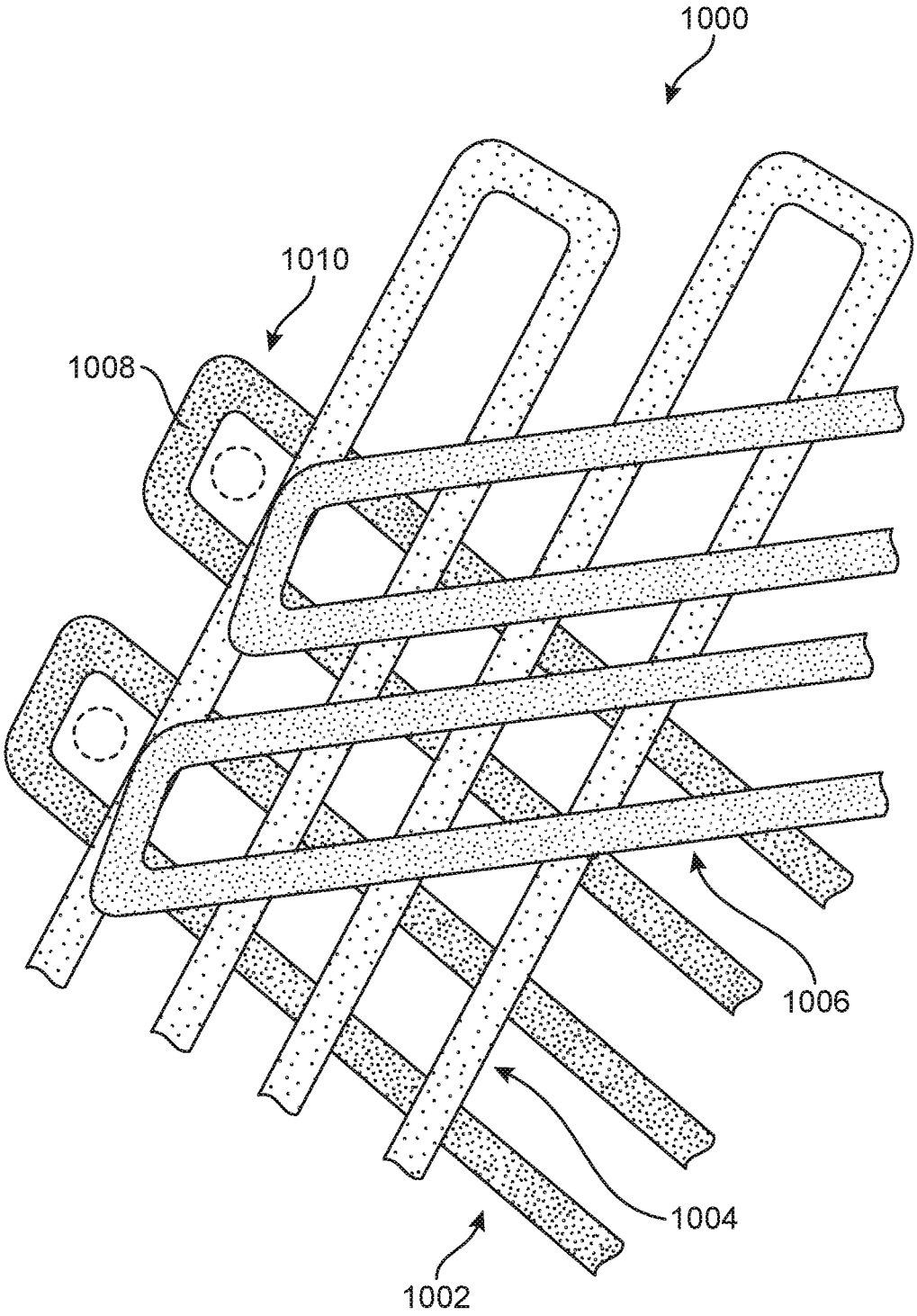
FIG. 16 is a schematic view of a ribbon structure including three ribbon layers, in which one layer includes loops for receiving a lace, according to an embodiment.
Figure 17:
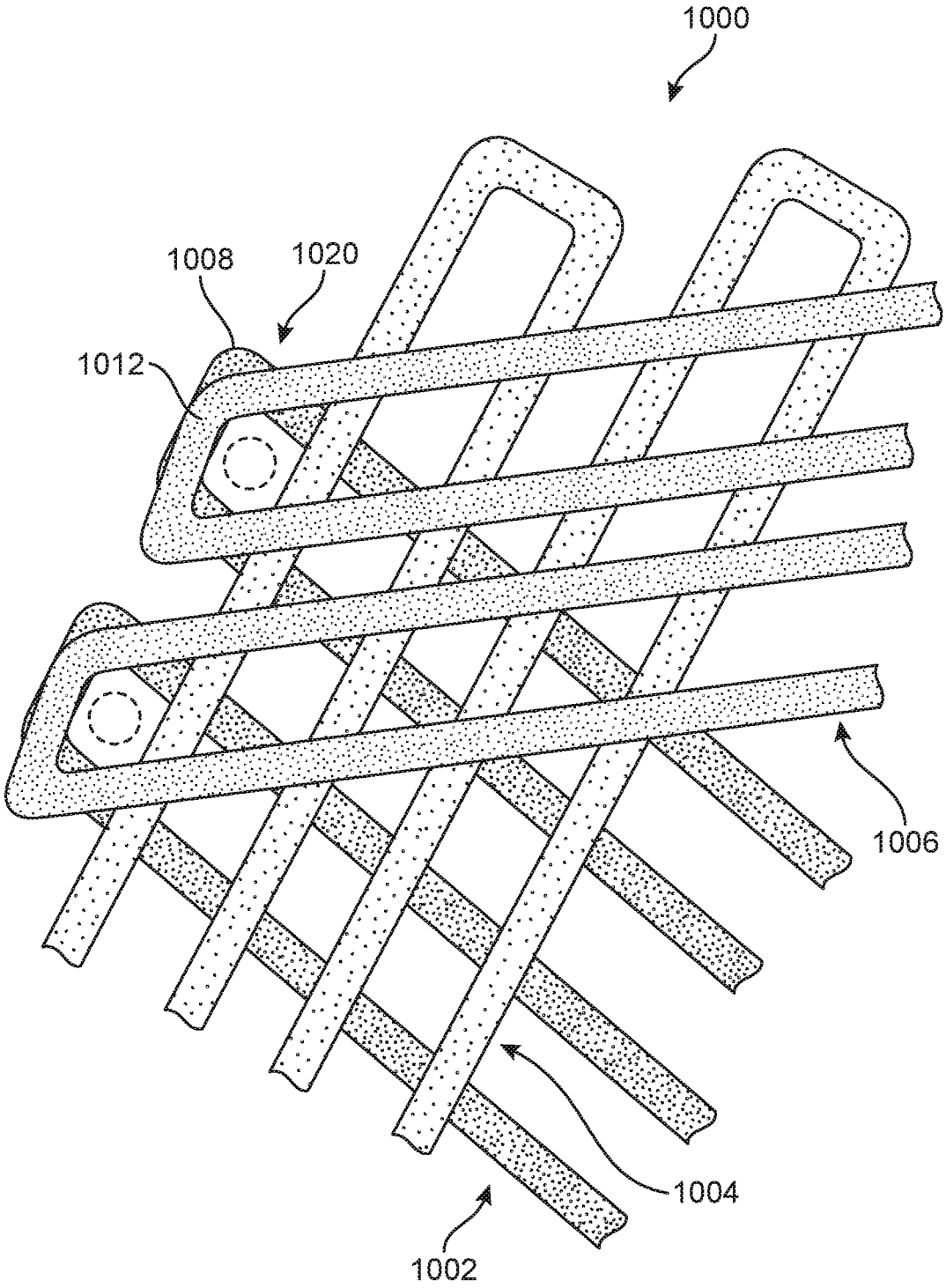
FIG. 17 is a schematic view of a ribbon structure including three ribbon layers, in which two layers include loops for receiving a lace, according to an embodiment.

Lace loops could be formed from two or more overlapping curved ribbon sections. In FIG. 16, three-layer ribbon structure 1000 includes first layer 1002, second layer 1004, and third layer 1006. In this case, lace loops 1010 may be formed using only open loop portions 1008 of first layer 1002. In another embodiment, shown in FIG. 17, lace loops 1020 may be formed by overlapping open loop portions 1008 of first layer 1002 and open loop portions 1012 of third layer 1006. In some cases, open loop portions 1012 of third layer 1006 may be stitched to open loop portions 1008 of first layer 1002. For purposes of clarity, the configurations of FIGS. 16 and 17 are shown without border elements; however, in some embodiments, border elements could be formed on the periphery of the ribbon structures.

Figure 18:
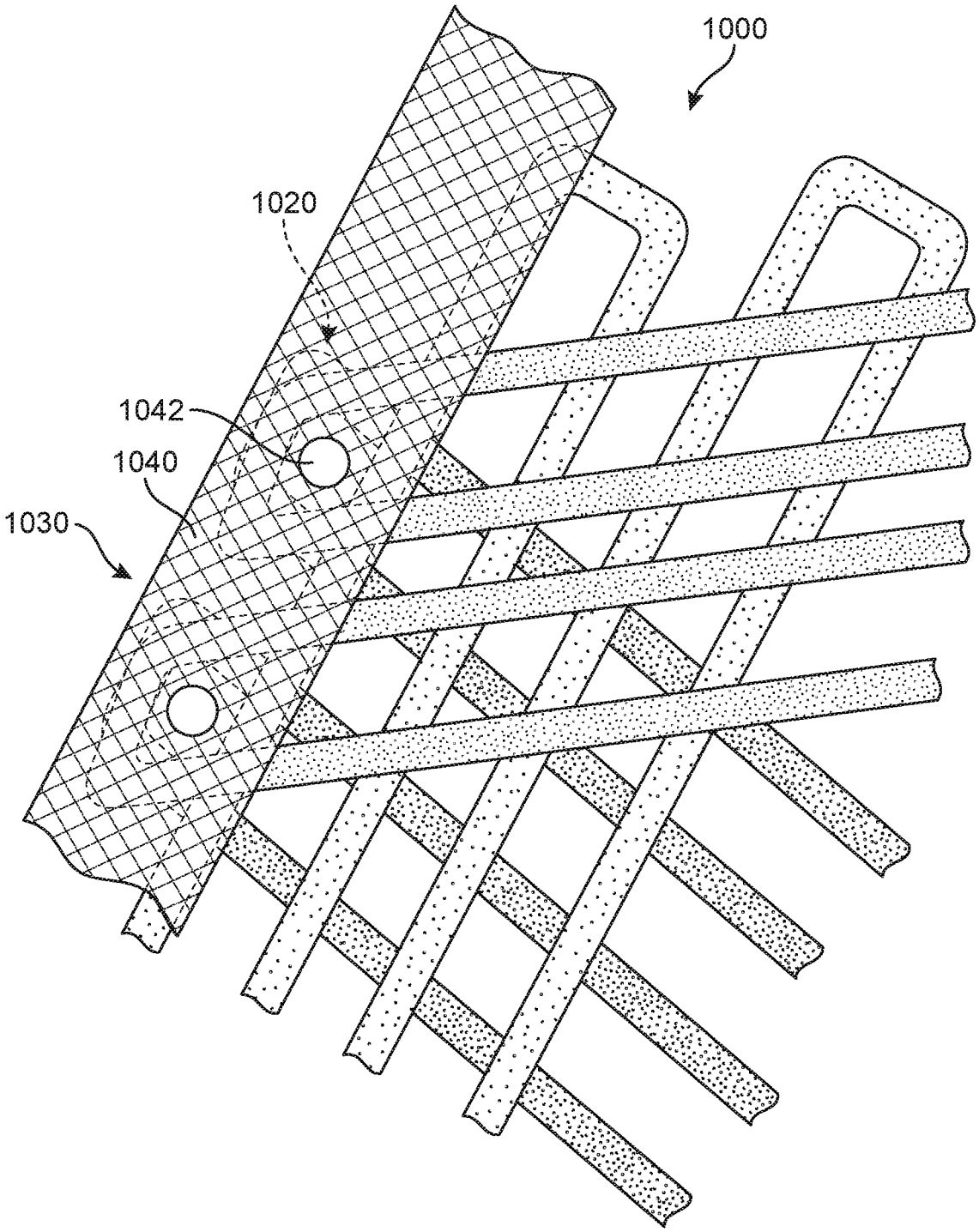
FIG. 18 is a schematic view of a ribbon structure including three layers, in which a border element covers loops of the ribbon structure, according to an embodiment.

In still another embodiment, rather than exposing sections of ribbon along the inner periphery of an upper to form lace loops, the loop forming sections could be covered over with an embroidered border element. For example, FIG. 18 illustrates a schematic view of the ribbon structure configuration of FIG. 17 in which periphery 1030 of three-layer ribbon structure 1000 and lace loops 1020 have been covered over with border element 1040. As seen in FIG. 18, border element 1040 may include openings 1042 that are aligned with lace loops 1020 to provide eyelets along the periphery of the upper.

In contrast to strands or other substantially one-dimensional materials that may be used, for example, in meshes, ribbon or substantially two-dimensional pieces of material (e.g., strips) may better resist stretching under tension, especially in a longitudinal direction. In some cases, using ribbons may also help increase comfort due to the increased surface contact area between the ribbons and a foot (or overlying layer of the foot, such as a sock, or other liner in the footwear).

The exemplary embodiments provide an upper including a ribbon structure. A ribbon structure may be comprised of a single continuous ribbon that is arranged into a pattern of overlapping ribbon portions or sections. Using a single continuous ribbon may help improve the efficiency of manufacturing by reducing the number of times a machine laying and attaching ribbon needs to stop or pause, and/or by reducing the need to include steps of cutting ribbons (either as the ribbon is laid down and/or prior to this). Moreover, by using a single continuous ribbon for the entire ribbon structure, the tendency of separate pieces of ribbon to separate at attachment points (e.g., stitching or welding points) may be reduced, resulting in increased strength and durability for the upper.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

The invention claimed is:

1. A method of making an upper for an article of footwear, comprising:

laying down a continuous ribbon element on a backing layer to form a first ribbon layer, wherein the continuous ribbon element forming the first ribbon layer includes a plurality of straight ribbon sections that are oriented in a first direction;

stitching a thread through the continuous ribbon element forming the first ribbon layer to attach the continuous ribbon element in place on the backing layer, and laying down another continuous ribbon element onto the backing layer and the first ribbon layer to form a second ribbon layer, wherein the second ribbon layer includes a plurality of straight ribbon sections that are oriented in a second direction that is different from the first direction;

wherein the plurality of straight ribbon sections of the first layer and the plurality of straight ribbon sections of the second layer have a width that is greater than a thickness to provide a two-dimensional appearance.

2. The method according to claim 1, wherein the continuous ribbon element forming the first ribbon layer includes a plurality of curved sections where the continuous ribbon element changes direction.

3. The method according to claim 2, wherein the plurality of curved sections are located along peripheral edges of the upper.

4. The method according to claim 1, wherein the second direction is approximately along a longitudinal direction of the upper.

5. The method according to claim 1, further comprising:

laying down at least one additional continuous ribbon element onto the backing layer, the first ribbon layer, and the second ribbon layer to form a third ribbon layer, wherein the third ribbon layer includes a plurality of straight ribbon sections that are oriented in a third direction that is different from the first direction and the second direction.

6. The method according to claim 5, wherein the orientations of the plurality of straight ribbon sections of the first ribbon layer, the second ribbon layer, and the third ribbon layer form a triaxial pattern such that openings formed between adjacent straight ribbon sections have a triangular geometry.

7. The method according to claim 5, wherein the third ribbon layer is formed by three continuous ribbon elements, including a first continuous ribbon element associated with a forefoot portion of the upper, a second continuous ribbon element associated with a lateral side of the upper, and a third continuous ribbon element associated with a medial side of the upper.

8. The method according to claim 1, wherein the method further includes removing the backing layer from the upper.

9. A method of making an upper for an article of footwear, comprising:

laying down a continuous ribbon element on a backing layer to form a ribbon structure;

repeatedly winding the continuous ribbon element back and forth between peripheral edges of the upper, including an outer peripheral edge and an inner peripheral edge;

stitching the continuous ribbon element in place to the backing layer;

wherein the ribbon structure includes a plurality of straight ribbon sections and a plurality of curved ribbon sections; and wherein the plurality of curved ribbon sections are disposed along the peripheral edges of the upper and form partial loops at each of the outer peripheral edge and the inner peripheral edge.

10. The method according to claim 9, wherein the ribbon structure includes at least two layers.

11. The method according to claim 10, wherein the ribbon structure includes three layers, wherein each layer includes a plurality of straight ribbon sections that have a different orientation from the plurality of straight ribbon sections of the other two layers.

12. The method according to claim 11, wherein the orientations of the three layers of the ribbon structure form a triaxial pattern such that openings formed between adjacent straight ribbon sections have a triangular geometry.

13. The method according to claim 10, wherein each layer of the ribbon structure is formed from a continuous ribbon element.

14. The method according to claim 9, wherein the method further includes removing the backing layer from the upper.

15. A method of making an upper for an article of footwear, comprising:

laying down a continuous ribbon element on a backing layer to form a first ribbon layer;

stitching the first ribbon layer to the backing layer;

laying down a continuous ribbon element on top of the first ribbon layer to form a second ribbon layer; and stitching the second ribbon layer to the first ribbon layer at a plurality of intersection points between ribbon sections of the first ribbon layer and ribbon sections of the second ribbon layer;

wherein the ribbon sections of the first layer and the ribbon sections of the second layer include switchbacks at peripheral edges of the upper where the ribbon sections substantially change direction so as to wind back and forth between the peripheral edges of the upper.

16. The method according to claim 15, wherein the ribbon sections of the first ribbon layer have a different orientation from the ribbon sections of the second ribbon layer.

17. The method according to claim 16, further comprising:

laying down at least one additional continuous ribbon element on top of the first ribbon layer and the second ribbon layer to form a third ribbon layer.

18. The method according to claim 17, wherein the third ribbon layer includes a plurality of ribbon sections that have a different orientation from the ribbon sections of the first ribbon layer and the second ribbon layer.

19. The method according to claim 18, wherein the orientations of the three layers of the ribbon structure form a triaxial pattern such that openings formed between adjacent ribbon sections have a triangular geometry.

20. The method according to claim 15, further comprising a border element attached over the peripheral edges of the upper and covering one or more of the switchbacks of the first ribbon layer and the second ribbon layer.

* * * * *